US006160971A

United States Patent [19]

Scheuer et al.

[11] Patent Number: 6,160,971

[45] Date of Patent: Dec. 12, 2000

[54] FEED FORWARD AND FEEDBACK TONER CONCENTRATION CONTROL FOR AN IMAGING SYSTEM

[75] Inventors: Mark A. Scheuer, Williamson; John Buranicz, Rochester; Patricia J. Donaldson, Pittsford; Paul A. Garsin, Webster; Eric M. Gross, Rochester; Eric S. Hamby, Fairport; Daniel W. MacDonald, Farmington, all of N.Y.; Prasad Padmanabhan, San Francisco, Calif.; Edward W. Smith, Jr., Rochester; Joseph W. Ward, Pittsford, both of N.Y.

[73] Assignee: Xerox Corporation, Stamford, Conn.

[21] Appl. No.: 09/428,341

[22] Filed: Oct. 27, 1999

[51] Int. Cl.[7] ..... G03G 15/08

[52] U.S. Cl. ..... 399/58; 399/27; 399/49; 430/120

[58] Field of Search ..... 399/58, 59, 61, 399/62, 63, 27, 28, 29, 30; 430/120

[56] References Cited

U.S. PATENT DOCUMENTS

| | | | |
|---|---|---|---|
| 5,162,874 | 11/1992 | Butler | 356/446 |
| 5,166,729 | 11/1992 | Rathbun et al. | 399/63 |
| 5,386,276 | 1/1995 | Swales et al. | 399/8 |
| 5,410,388 | 4/1995 | Pacer et al. | 399/49 |
| 5,581,335 | 12/1996 | Borton et al. | 399/30 |
| 5,678,131 | 10/1997 | Alexandrovich et al. | 399/58 |
| 5,705,307 | 1/1998 | Tyagi et al. | 430/120 |
| 5,710,958 | 1/1998 | Raj | 399/49 |
| 5,749,023 | 5/1998 | Grace et al. | 399/58 |
| 5,777,656 | 7/1998 | Henderson | 347/251 |
| 5,839,022 | 11/1998 | Wang et al. | 399/62 |
| 5,887,221 | 3/1999 | Grace | 399/49 |
| 6,025,862 | 2/2000 | Thompson | 347/232 |
| 6,035,152 | 3/2000 | Craig et al. | 399/49 |
| 6,047,142 | 4/2000 | Donaldson | 399/27 |

OTHER PUBLICATIONS

U.S. Patent Application Serial No. 09/318,953, filed May 26, 1999, entitled "Toner Age Calculation in Print Engine Diagnostic".

*Primary Examiner*—Sophia S. Chen
*Attorney, Agent, or Firm*—Paul F. Daebeler

[57] ABSTRACT

The present invention generally relates to an imaging system, and more specifically, a method and apparatus for accurately predicting toner usage and hence toner dispensing requirements in an imaging system. More specifically, the present invention relates to a toner concentration control system for maintaining toner concentration in a developer structure, which is connected to a dispenser containing toner. The toner concentration control system includes a toner mass estimator providing a toner mass estimate of the toner mass in the developer structure to be applied to the photoreceptor; a feed forward dispense unit receiving the toner mass estimate and transmitting a feed forward dispense command based on the toner mass estimate; a toner concentration target adjusted for toner break-in in the developer structure; a feed back dispense unit receiving the adjusted toner concentration target and transmitting a feedback dispense command; and a total dispense unit receiving the feed forward dispense command and the feedback dispense command, and outputting total dispense command to the dispenser, which dispenses the toner to the developer structure in accordance with the total dispense command.

25 Claims, 12 Drawing Sheets

FIG. 10
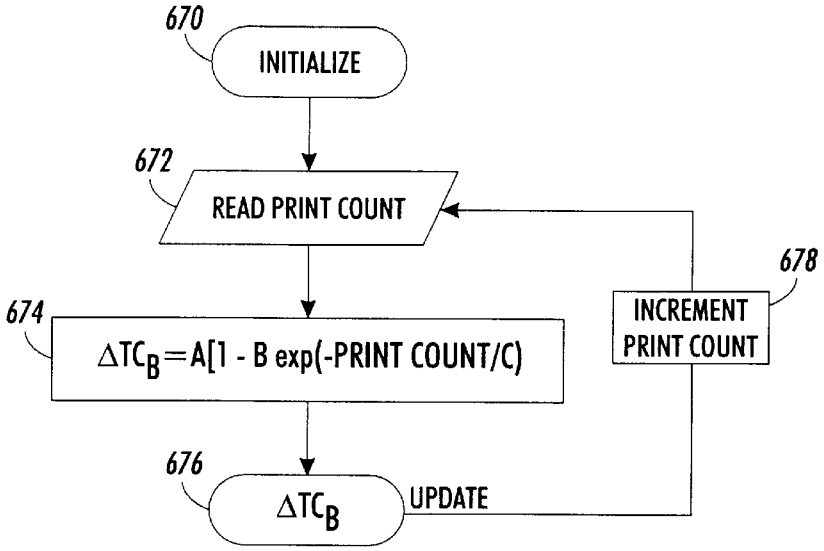
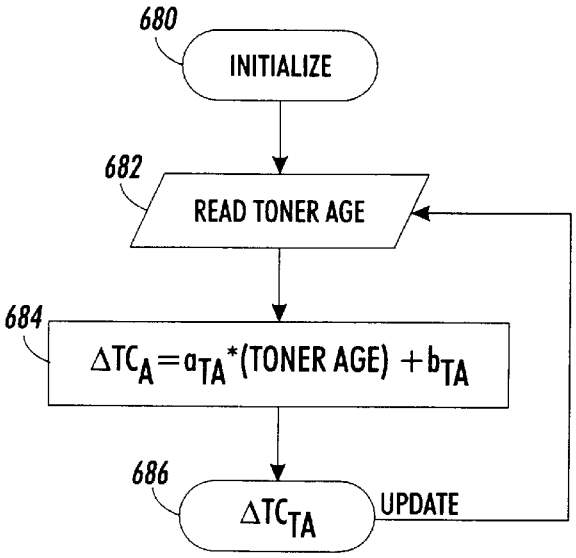
FIG. 11

FEED FORWARD AND FEEDBACK TONER CONCENTRATION CONTROL FOR AN IMAGING SYSTEM

FIELD OF THE INVENTION

The present invention generally relates to an imaging system, and more specifically, a method and apparatus for accurately predicting toner usage and hence toner dispensing requirements in an imaging system.

BACKGROUND OF THE INVENTION

Modern electronic copiers, printers, facsimile machines, etc. are capable of producing complex and interesting page images. The pages may include text, graphics, and scanned or computer-generated images. The image of a page may be described as a collection of simple image components or primitives (characters, lines, bitmaps, colors, etc.). Complex pages can then be built by specifying a large number of the basic image primitives. This is done in software using a page description language such as PostScript. The job of the electronic printer's software is to receive and interpret each of the imaging primitives for the page. The drawing or rasterization must be done on an internal, electronic model of the page. All image components must be collected and the final page image must be assembled before marking can begin. The electronic model of the page is often constructed in a data structure called an image buffer. The data contained is in the form of an array of color values called pixels. Each actual page and the pixel's value give the color, which should be used when marking. The pixels are organized to reflect the geometric relation of their corresponding spots. They are usually ordered to provide easy access in the raster pattern required for marking.

In the prior art, a copier, printer or other digital imaging system typically employs an initial step of charging a photoconductive member (photoreceptor) to a substantially uniform potential. The charged surface of the photoconductive member is thereafter exposed to a light image of an original document to selectively dissipate the charge thereon in selected areas irradiated by the light image. This procedure records an electrostatic latent image on the photoconductive member corresponding to the informational areas contained within the original document being reproduced. The latent image is then developed by bringing a developer including toner particles adhering triboelectrically to carrier granules into contact with the latent image. The toner particles are attracted away from the carrier granules to the latent image, forming a toner image on the photoconductive member, which is subsequently transferred to a copy sheet. The copy sheet having the toner image thereon is then advanced to a fusing station for permanently affixing the toner image to the copy sheet.

The approach utilized for multicolor electrostatographic printing is substantially identical to the process described above. However, rather than forming a single latent image on the photoconductive surface in order to reproduce an original document, as in the case of black and white printing, multiple latent images corresponding to color separations are sequentially recorded on the photoconductive surface. Each single color electrostatic latent image is developed with toner of a color complimentary thereto and the process is repeated for differently colored images with the respective toner of complimentary color. Thereafter, each single color toner image can be transferred to the copy sheet in superimposed registration with the prior toner image, creating a multi-layered toner image on the copy sheet. Finally, this multi-layered toner image is permanently affixed to the copy sheet in substantially conventional manner to form a finished copy.

With the increase in use and flexibility of printing machines, especially color printing machines which print with two or more different colored toners, it has become increasingly important to monitor the development process so that increased print quality and improved stability can be met and maintained. For example, it is very important for each component color of a multi-color image to be stably formed at the correct toner density because any deviation from the correct toner density may be visible in the final composite image. Additionally, deviations from desired toner densities may also cause visible defects in mono-color images, particularly when such images are half-tone images. Therefore, many methods have been developed to monitor the toner development process to detect present or prevent future image quality problems.

Developability is the rate at which development (toner mass/area) takes place. The rate is usually a function of the toner concentration in the developer housing. Toner concentration (TC) is measured by directly measuring the percentage of toner in the developer housing (which, as is well known, contains toner and carrier particles).

As indicated above, one benchmark in the suitable development of a latent electrostatic image on a photoreceptor by toner particles is the correct toner concentration in the developer. An incorrect concentration, i.e. too much toner concentration, can result in too much background in the developed image. That is, the white background of an image becomes colored. On the other hand, too little toner concentration can result in deletions or lack of toner coverage of the image. Therefore, in order to ensure good developability, which is necessary to provide high quality images, toner concentration must be continually monitored and adjusted. In order to provide the appropriate amount of toner concentration, toner usage is determined. Through the use of a toner concentration control system having a feed forward component and a feedback component, the toner concentration and toner usage are determined in order to adjust the toner dispenser to dispense the proper amount of toner for a particular job.

In a pure feedback control system for toner concentration (TC), perturbations in toner concentration will be sensed by an in-housing sensor (e.g., Packer sensor, which is shown in U.S. Pat. No. 5,166,729). This approach is affected by considerable system transport delay. This results in inadequate control of toner concentration, particularly with frequently varying toner consumption.

However, toner concentration control can be greatly improved by knowing the customer usage in advance. This enables the toner concentration control system to add toner in a feed forward (FF) fashion as prints are made. Thus, according to the prior art, actual images generated by the raster output scanner for the customer were used to estimate actual toner usage. By summing the actual pixels written by the raster output scanner, a proportional amount of toner was dispensed in a feed forward manner. This reduced the load on a feedback portion of the toner concentration control system whose function of adjusting the toner dispensing to maintain the developed mass per unit area (developability) of images on the photoreceptor was, consequently, made to run with less spurious transient behavior.

Similar or even better results are desired in the control of the magenta, yellow, cyan and black separations of a full process color xerographic device using image on image technology. Image on image technology (IOI) is the process of placing successive color separations on top of each other by recharging predeveloped images and exposing them. Unfortunately, there are large errors in the estimation of yellow, cyan and black toner usage. For example, yellow toner develops to a lesser degree on magenta than on a bare photoreceptor. Cyan toner develops to a lesser degree on yellow toner and magenta toner than on a bare photoreceptor. Black toner develops to a lesser degree on cyan toner, yellow toner and magenta toner than on a bare photoreceptor. This is due to a reduction of raster output exposure through scattering in passing through developed toner layers on the photoreceptor. The reduced light exposure results in a reduced development field, and thus a reduced developed mass compared to the bare portion of the photoreceptor.

Consequently, there is a need to provide a method and apparatus for minimizing the impact of the above problems to maintain the proper amount of toner concentration by dispensing the proper amount of toner to ensure high image quality.

SUMMARY OF THE INVENTION

A toner concentration control system for maintaining toner concentration in a developer structure, which is connected to a dispenser containing toner, the toner concentration control system comprising: a toner mass estimator providing a toner mass estimate of the toner mass in the developer structure to be applied to the photoreceptor; a feed forward dispense unit receiving the toner mass estimate and transmitting a feed forward dispense command based on the toner mass estimate; a toner concentration target adjusted for toner break-in in the developer structure; a feed back dispense unit receiving the adjusted toner concentration target and transmitting a feedback dispense command; and a total dispense unit receiving the feed forward dispense command and the feedback dispense command, and outputting total dispense command to the dispenser, which dispenses the toner to the developer structure in accordance with the total dispense command.

The toner concentration control system may further comprise a toner concentration target adjusted for both toner age and toner break-in before the adjusted toner concentration target is received by the feedback dispense unit. The toner may be selected from the group consisting of magenta, yellow, cyan and black. Alternatively, the toner may be a magnetic ink character recognition toner.

A method for maintaining toner concentration in a developer structure which is connected to a dispenser and which applies toner to a photoreceptor, the method comprising: estimating mass of the toner in the developer structure to be applied to the photoreceptor; generating a feed forward dispense command based on the toner mass estimate; providing a toner concentration target; determining age of the toner in the developer structure; adjusting the toner concentration target based on the toner break-in in the developer structure; generating a feedback dispense command based on the adjusted toner concentration target; generating a total dispense command by combining the feed forward dispense command with the feedback dispense command; and dispensing the toner from the dispenser into the developer structure to maintain toner concentration in the developer structure.

The method for maintaining toner concentration may further comprise adjusting the toner concentration target for toner age before the adjusted toner concentration target is received by the feedback dispense unit. The toner may be selected from the group consisting of magenta, yellow, cyan and black. Alternatively, the toner is a magnetic ink character recognition toner. A toner concentration control system for use with developer structures containing different toners to be applied to a latent image on a photoreceptor, each developer structure connected to a corresponding dispenser and each dispenser containing a different toner, the toner concentration control system comprising: a plurality of toner mass estimators providing an estimate of the toner mass in each developer structure to be applied to the photoreceptor; a plurality of feed forward dispense units receiving corresponding toner mass estimates and transmitting feed forward dispense commands based on the toner mass estimates; a plurality of toner concentration targets, each toner concentration target adjusted by toner break-in in the corresponding developer structures; a plurality of feedback dispense units receiving the corresponding adjusted toner concentration targets and transmitting feedback dispense commands; and a plurality of total dispense units, each receiving the corresponding feed forward dispense command and the corresponding feedback dispense command, and outputting corresponding total dispense commands to the corresponding dispensers, which dispense the corresponding toners to the corresponding developer structures in accordance with the total dispense commands.

The toner concentration control system may further comprise toner concentration targets adjusted for both toner age and toner break-in before the adjusted toner concentration targets are received by the feedback dispense units. The toner concentration control system may comprise four developer structures, wherein a first developer structure includes magenta toner, a second developer structure includes yellow toner, a third developer structure includes cyan toner and a fourth developer structure includes black toner. Alternatively, at least one of the four developer structures contains a magnetic ink character recognition toner. Alternatively, the toner concentration control system may also include a fifth developer structure containing a magnetic ink character recognition toner.

A method for maintaining toner concentration in a plurality of developer structures containing different toners to be applied to a latent image on a photoreceptor, each developer structure being connected to a corresponding dispenser and each dispenser containing a different toner, the method comprising: estimating mass of each toner to be applied to the photoreceptor; generating a feed forward dispense command for each developer structure based on the corresponding toner mass estimate; providing a toner concentration target for each toner in each developer structure; determining age of the toner in each developer structure; adjusting each toner concentration target based on the toner break-in in each corresponding developer structure; generating feedback dispense commands for each developer structure based on the corresponding adjusted toner concentration targets; generating total dispense commands for each developer structure by combining corresponding feed forward dispense commands with corresponding feedback dispense commands; and dispensing toners from dispensers into the corresponding developer structures to maintain toner concentrations in the developer structures.

The method for maintaining toner concentration further comprising adjusting the toner concentration target for toner age before the adjusted toner concentration target is received by the feedback dispense unit. The method for maintaining toner concentration in a first developer structure including magenta toner, a second developer structure includes yellow toner, a third developer structure includes cyan toner and a fourth developer structure includes black toner. Alternatively, the toner concentration control system includes at least one developer structure containing a magnetic ink character recognition toner. Alternatively, the toner concentration control system includes a fifth developer structure containing a magnetic ink character recognition toner.

A digital imaging system for generating an image from image signals comprising: a photoreceptor; a plurality of charging units charging the photoreceptor; a plurality of exposure units receiving the image signals and exposing the photoreceptor to place a latent image on the photoreceptor based on the image signals; a plurality of developer structures, each developer structure being connected to a corresponding dispenser, and each dispenser having a different toner; a plurality of toner mass estimators providing toner mass estimates to be applied to a photoreceptor by way of the developer structures; a plurality of feed forward dispense units receiving the toner mass estimates and transmitting feed forward dispense commands based on the toner mass estimates; a plurality of toner concentration targets, each toner concentration target being adjusted by toner break-in in the corresponding developer structure; a plurality of feedback dispense units receiving the adjusted toner concentration targets and transmitting feedback dispense commands; a plurality of total dispense units, each total dispense unit receiving the corresponding feed forward dispense command and the corresponding feedback dispense command, and each total dispense unit outputting a corresponding total dispense command to each corresponding dispenser, each corresponding dispenser; dispensing corresponding toner to the corresponding developer structure in accordance with the corresponding total dispense command to maintain toner concentration in each developer structure so that each toner is applied to the latent image; a transfer unit transferring the toner on the photoreceptor to a support material; a fusing unit fusing the toner to the support material; and a cleaner cleaning the photoreceptor after the support material has passed through the transfer unit.

The toner concentration control system further comprises toner concentration targets adjusted for both toner age and toner break-in before the adjusted toner concentration targets are received by the feedback dispense units.

The digital imaging system further comprises a scanner for scanning the image, generating the image signals and transmitting the image signals to the exposure unit. The digital imaging system may be coupled to a computer network and receives image signals from the computer network. The toner concentration control system may comprise four developer structures, wherein a first developer structure includes magenta toner, a second developer structure includes yellow toner, a third developer structure includes cyan toner and a fourth developer structure includes black toner. Alternatively, the toner concentration control system includes at least one developer structure containing a magnetic ink character recognition toner. Alternatively, the toner concentration control system includes a fifth developer structure containing a magnetic ink character recognition toner.

BRIEF DESCRIPTION OF THE DRAWINGS

FIG. 10 is a flow chart showing break-in feedback toner concentration control for each developer station in accordance with the present invention;

FIG. 11 is a flow chart showing toner age feedback toner concentration control for each developer station in accordance with the present invention.

DESCRIPTION OF THE PREFERRED EMBODIMENTS

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined in the appended claims.

Figure 1:
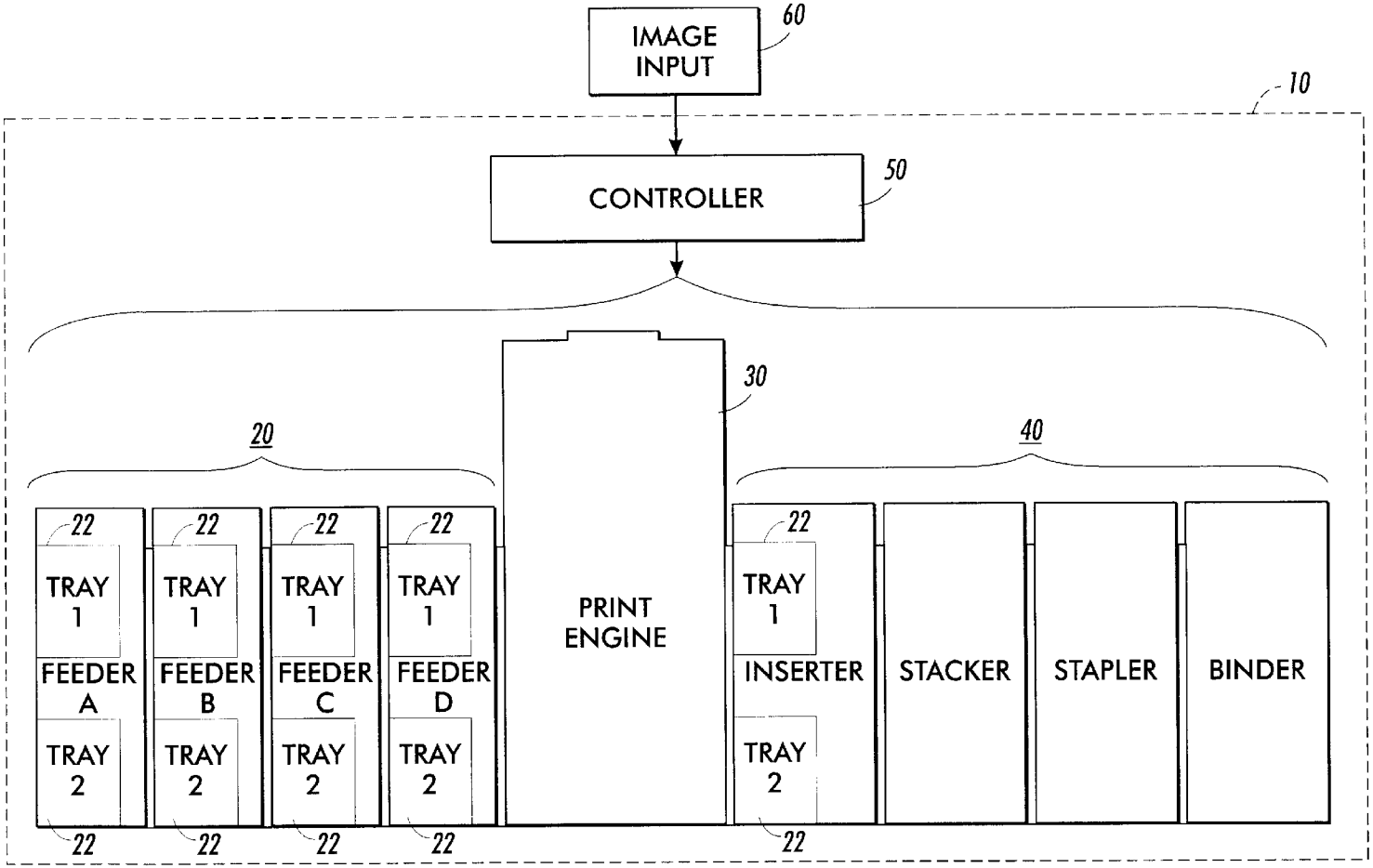
FIG. 1 shows a digital printing system into which the feed forward toner concentration control system may be incorporated.

FIG. 1 shows a digital printing system 10 of the type suitable for use with the preferred embodiment for processing print jobs. As shown, the digital printing system includes document feeders 20, a print engine 30, finishers 40 and controller 50. The digital printing system 10 is coupled to an image input section 60.

Figure 2:
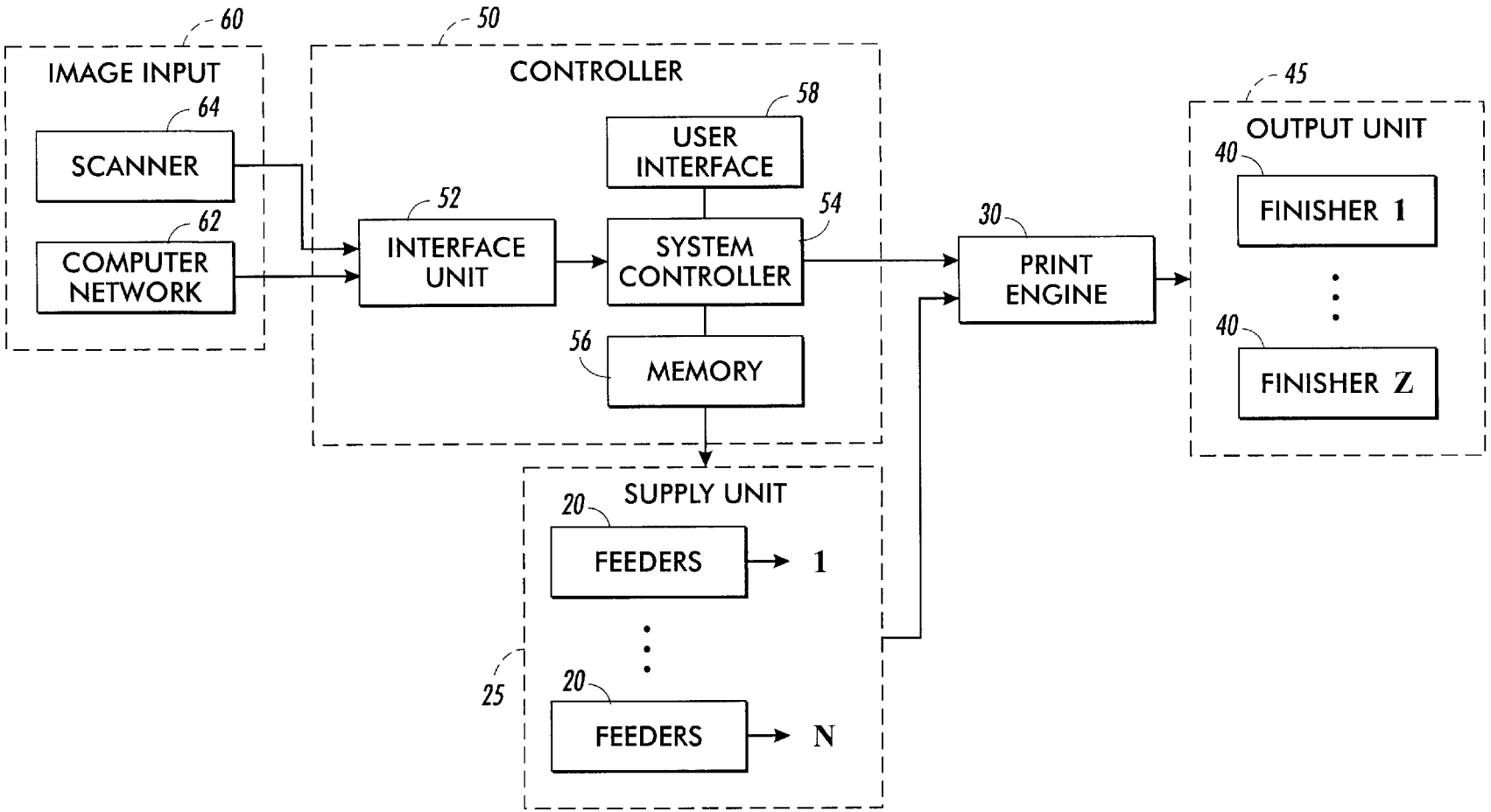
FIG. 2 is a general block diagram of the printing system shown in FIG. 1.

As shown in FIG. 2, the image input section 60 transmits signals to the controller 50. In the example shown, image input section 60 has both remote and onsite image inputs, enabling the digital printing system 10 to provide network, scan and print services. In this example, the remote image input is a computer network 62, and the onsite image input is a scanner 64. However, the digital printing system 10 can be coupled to multiple networks or scanning units, remotely or onsite. Other systems can be envisioned such as stand alone digital printing system with on-site image input, controller and printer. While a specific digital printing system is shown and described, the present invention may be used with other types of printing systems such as analog printing systems.

The digital printing system 10 can receive image data, which can include pixels, in the form of digital image signals for processing from the computer network 62 by way of a suitable communication channel, such as a telephone line, computer cable, ISDN line, etc. Typically, computer networks 62 include clients who generate jobs, wherein each job includes the image data in the form of a plurality of electronic pages and a set of processing instructions. In turn, each job is converted into a representation written in a page description language (PDL) such as PostScript® containing the image data. Where the PDL of the incoming image data is different from the PDL used by the digital printing system 10, a suitable conversion unit converts the incoming PDL to the PDL used by the digital printing system 10. The suitable conversion unit may be located in an interface unit 52 in the controller 50. Other remote sources of image data such as a floppy disk, hard disk, storage medium, scanner, etc. may be envisioned.

The controller 50 controls and monitors the entire digital printing system 10 and interfaces with both on-site and remote input units in the image input section 60. The controller 50 includes the interface unit 52, a system controller 54, a memory 56 and a user interface 58. For on-site image input, an operator may use the scanner 64 to scan documents, which provides digital image data including pixels to the interface unit 52. Whether digital image data is received from scanner 64 or computer network 62, the interface unit 52 processes the digital image data into the document information required to carry out each programmed job. The interface unit 52 is preferably part of the digital printing system 10. However, the components in the computer network 62 or the scanner 64 may share the function of converting the digital image data into the document information, which can be utilized by the digital printing system 10.

As indicated previously, the digital printing system 10 includes one or more feeders 20, print engine 30, finishers 40 and controller 50. Each feeder 20 preferably includes one or more trays 22, which forward different types of support material to the print engine 30. All of the feeders 20 in the digital printing system 10 are collectively referred to as a supply unit 25. Preferably, the print engine 30 has at least four developer stations. Each developer station has a corresponding developer structure. Each developer structure preferably contains one of magenta, yellow, cyan or black toner. The print engine 30 may comprise additional developer stations having developer structures containing other types of toner such as MICR (magnetic ink character recognition) toner. The print engine 30 may also comprise one, two or three developer structures having one, two or three different types of toner, respectively. Further, all of the finishers 40 are collectively referred to as an output unit 45. The output unit 45 may comprise one or more finishers 40 such as inserters, stackers, staplers, binders, etc., which take the completed pages from the print engine 30 and use them to provide a finished product.

As indicated above, an imaging system typically employs an initial step of charging a photoconductive member to a substantially uniform potential (station A) and thereafter exposing the photoconductive member to record a latent image (station B). FIGS. 3–6 show toner concentration control systems for four developer stations (C–F) for bringing developer including toner particles into contact with the latent image on a photoconductive member. Each of the developer stations is preferably preceded by an exposure process. Further, each of the developer stations preferably includes a developer structure and a corresponding dispenser for supplying toner particles to the developer structure. Preferably, each developer station is applying a different type of toner to the latent image. Preferably, developer station C is applying magenta toner, developer station D is applying yellow toner, developer station E is applying cyan toner and developer station F is applying black toner. As indicated above, additional stations applying other types of toner, such as MICR toner, may be added.

In order to properly bring the toner particles in contact with the latent image, a proper toner concentration must be maintained in each developer structure. Each toner concentration control system comprises a feed forward component and a feedback component to ensure the proper amount of toner is dispensed into each developer structure to maintain the proper toner concentration in each developer structure. By determining the amount of toner required to develop the latent image (feed forward component) and the impact of temperature, break-in and toner age of the toner particles in each developer structure (feedback component), the proper toner concentration in each developer structure is maintained.

Turning first to the feed forward component of the toner concentration control system, the latent image on the photoconductive member has a certain number of pixels to be developed. Each pixel requires a predetermined mass of toner, and the mass of each type of toner is different. The toner required to develop the latent image at each station may be estimated based on the mass of the type of toner at the station and the pixel count of the latent image.

Figure 3:
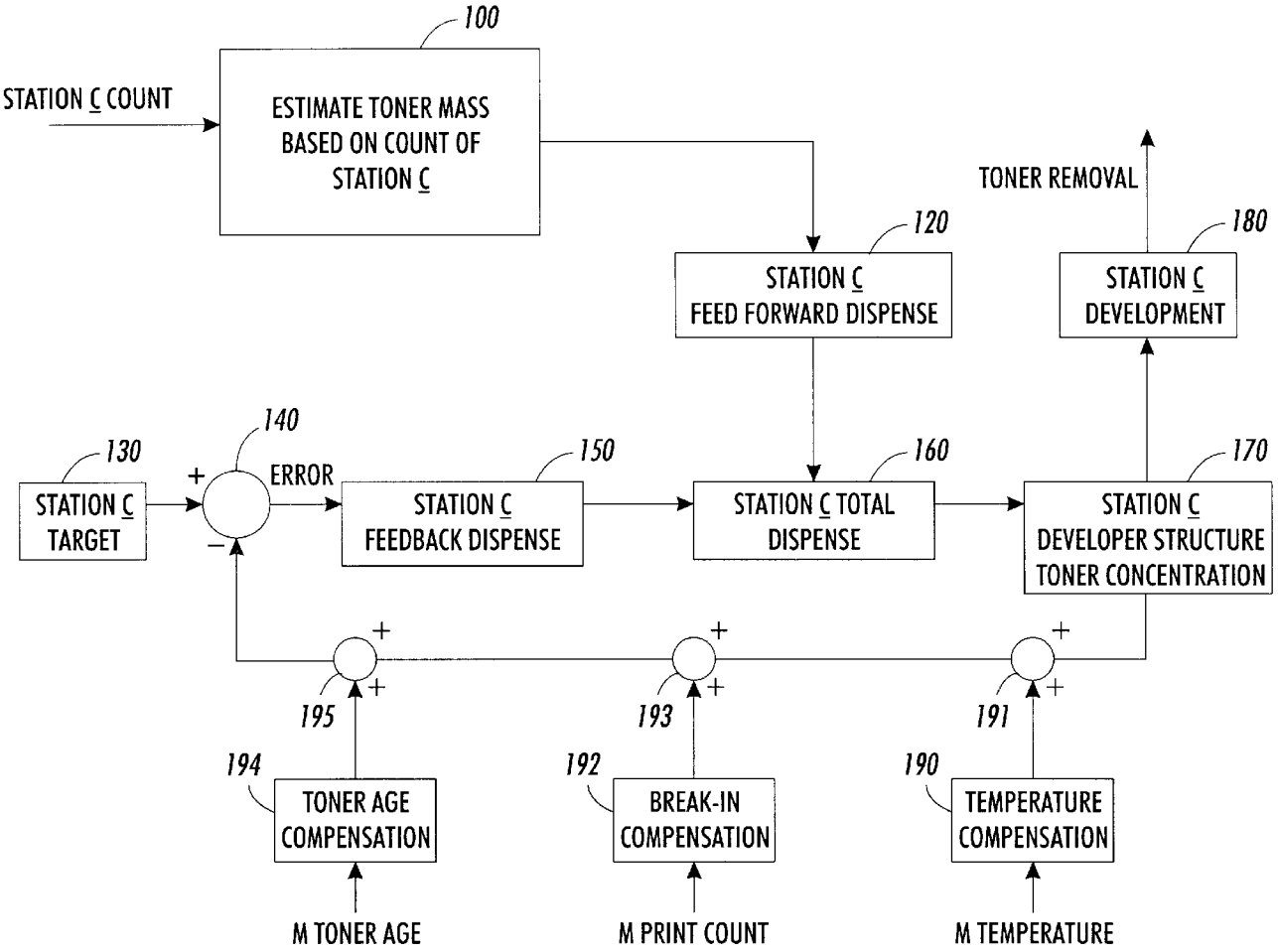
FIG. 3 is a block diagram showing both a feed forward and feedback toner concentration control for the first developer station in accordance with the present invention.

As shown in FIG. 3, the magenta toner mass of developer station C to be applied to the photoreceptor is estimated based on the pixel count of station C (100), and outputted to the station C feed forward dispense 120. The station C feed forward dispense 120 provides a feed forward dispense command to the station C total dispense 160. The station C feed forward dispense 120 provides a feed forward dispense command to request that a certain magenta toner mass per unit time be dispensed to the developer structure of station C to replace the magenta toner removed from the station C developer structure in order to maintain the proper magenta toner concentration (station C feed forward dispense 120).

The actual developer station C target of magenta toner concentration within the developer structure is generally referred to by reference numeral 130. However, due to the impact of the temperature, break-in and toner age of the magenta toner particles in the developer structure, and due to the type of sensor (preferably a Packer sensor) used to obtain readings to measure magenta toner concentration, the sensor can not directly measure the actual magenta toner concentration. The sensor readings indicative of the current magenta toner concentration of the developer structure of station C are compensated or corrected for variations in temperature (190, 191), break-in (192, 193) and toner age (194, 195). Then, the compensated or corrected magenta toner concentration is combined with the station C target toner concentration (140) to provide an error signal that is input to the feedback dispense 150. The feedback dispense 150 processes the error signal and outputs a feedback command to station C total dispense 160. The station C feedback command provides a dispense command to request that a certain magenta toner mass per unit time be dispensed to compensate or correct for variations in temperature, break-in and toner age in order to maintain the proper magenta toner concentration (station C feed back dispense 150).

The total magenta mass of toner dispensed by the station C toner dispenser is determined by combining the station C feed forward dispense command with the station C feedback dispense command. The station C total dispense 160 combines the station C feed forward dispense command with the station C feedback dispense command, and outputs a station C total dispense command so that a certain magenta toner mass per unit time is dispensed from the station C dispenser to the station C developer structure. By dispensing the proper magenta toner mass, the station C developer structure toner concentration (170) can be maintained while the magenta toner is being removed from the station C developer structure and adhering to the latent image on the photoreceptor (station C development 180).

Figure 4:
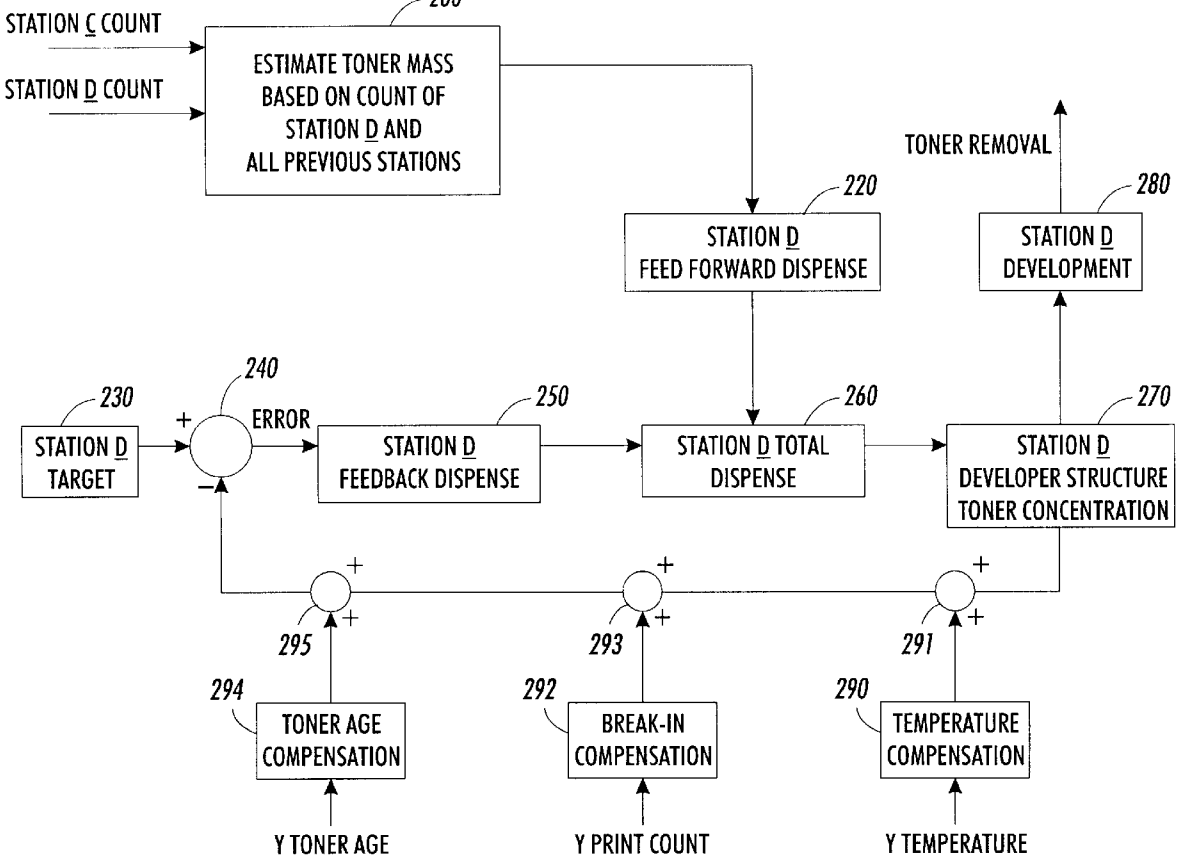
FIG. 4 is a block diagram showing both a feed forward and feedback toner concentration control for the second developer station in accordance with the present invention.

Turning to FIG. 4, the yellow toner mass of developer station D to be applied to the photoreceptor is estimated based on pixel count of station D and all previous stations (200). The yellow toner mass estimate is outputted to the station D feed forward dispense 220. The developer station D feed forward dispense 220 provides a feed forward dispense command to the station D total dispense 260. The station D feed forward dispense 220 provides a feed forward dispense command to request that a certain yellow toner mass per unit time be dispensed to the developer structure of station D to replace the yellow toner removed from the station D developer structure in order to maintain the proper yellow toner concentration (station D feed forward dispense 220).

The actual developer station D target of yellow toner concentration within the developer structure is generally referred to by the reference numeral 230. However, due to the impact of the temperature, break-in and toner age of the yellow toner particles in the developer structure, and due to the type of sensor (e.g. Packer sensor) used to obtain readings to measure the yellow toner concentration, the sensor can not directly measure the actual yellow toner concentration. The sensor readings indicative of the current yellow toner concentration of the developer structure of station D are compensated or corrected for variations in temperature (290, 291), break-in (292, 293) and toner age (294, 295). Then, the compensated or corrected yellow toner concentration is combined with the station D target toner concentration (240) to provide an error signal that is input to the feedback dispense 250. The feedback dispense 250 processes the error signal and outputs a feedback command to station D total dispense 260. The station D feedback command provides a dispense command to request that a certain yellow toner mass per unit time be dispensed to compensate or correct for variations in temperature, break-in and toner age in order to maintain the proper yellow toner concentration (station D feed back dispense 250).

The total yellow toner mass dispensed by the station D toner dispenser is determined by combining the station D feed forward dispense command with the station D feedback dispense command. The station D total dispense 260 combines the station D feed forward dispense command with the station D feedback dispense command, and outputs a station D total dispense command so that a certain yellow toner mass per unit time is dispensed from the station D dispenser to the station D developer structure. By dispensing the proper yellow toner mass, the station D developer structure toner concentration (270) can be maintained while the yellow toner is being removed from the station D developer structure and adhering to the latent image on the photoreceptor (station D development 280).

Figure 5:
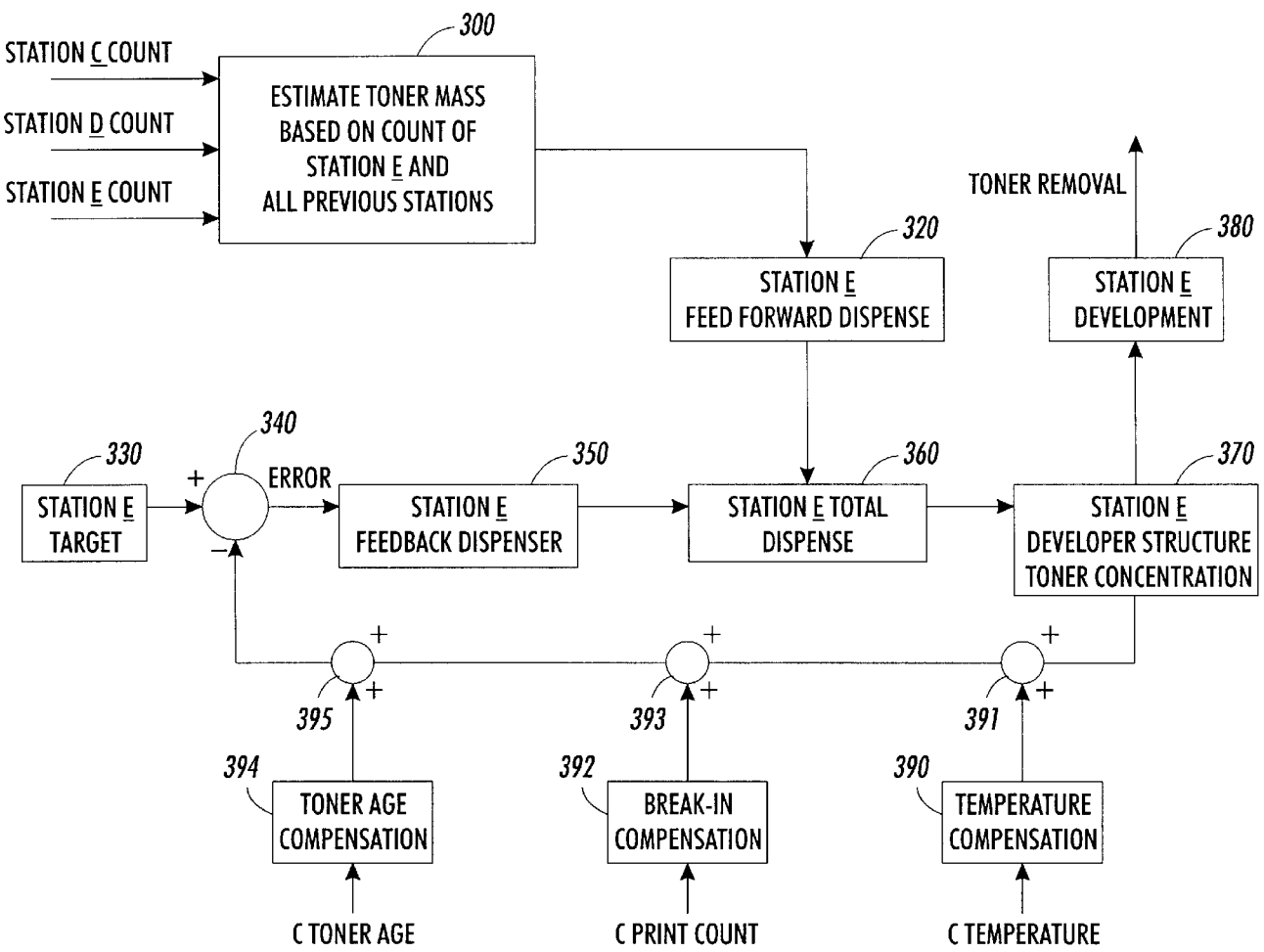
FIG. 5 is a block diagram showing both a feed forward and feedback toner concentration control for the third developer station in accordance with the present invention.

Turning to FIG. 5, the cyan toner mass of developer station E to be applied to the photoreceptor is estimated based on pixel count of station E and all previous stations (300). The cyan toner mass estimate is outputted to the station E feed forward dispense 320. The developer station E feed forward dispense 320 provides a feed forward dispense command to the station E total dispense 360. The station E feed forward dispense 320 provides a feed forward dispense command to request that a certain cyan toner mass per unit time be dispensed to the developer structure of station E to replace the cyan toner removed from the station E developer structure in order to maintain the proper cyan toner concentration (station E feed forward dispense 320).

The actual developer station E target of cyan toner concentration within the developer structure is generally referred to by the reference numeral 330. However, due to the impact of the temperature, break-in and toner age of the cyan toner particles in the developer structure, and due to the type of sensor (e.g. Packer sensor) used to obtain readings to measure cyan toner concentration, the sensor can not directly measure the actual cyan toner concentration. The sensor readings indicative of the current cyan toner concentration of the developer structure of station E are compensated or corrected for variations in temperature (390, 391), break-in (392, 393) and toner age (394, 395). Then, the compensated or corrected cyan toner concentration is combined with the station E target toner concentration (340) to provide an error signal that is input to the feedback dispense 350. The feedback dispense 350 processes the error signal and outputs a feedback command to station E total dispense 360. The station E feedback command provides a dispense command to request that a certain cyan toner mass per unit time be dispensed to compensate or correct for variations in temperature, break-in and toner age in order to maintain the proper cyan toner concentration (station E feed back dispense 350).

The total cyan toner mass dispensed by the station E toner dispenser is determined by combining the station E feed forward dispense command with the station E feedback dispense command. The station E total dispense command 360 combines the station E feed forward dispense command with the station E feedback dispense command, and outputs a station E total dispense command so that a certain cyan toner mass per unit time is dispensed from the station E dispenser to the station E developer structure. By dispensing the proper cyan toner mass, the station E developer structure toner concentration (370) can be maintained while the cyan toner is being removed from the station E developer structure and adhering to the latent image on the photoreceptor (station E development 380).

Figure 6:
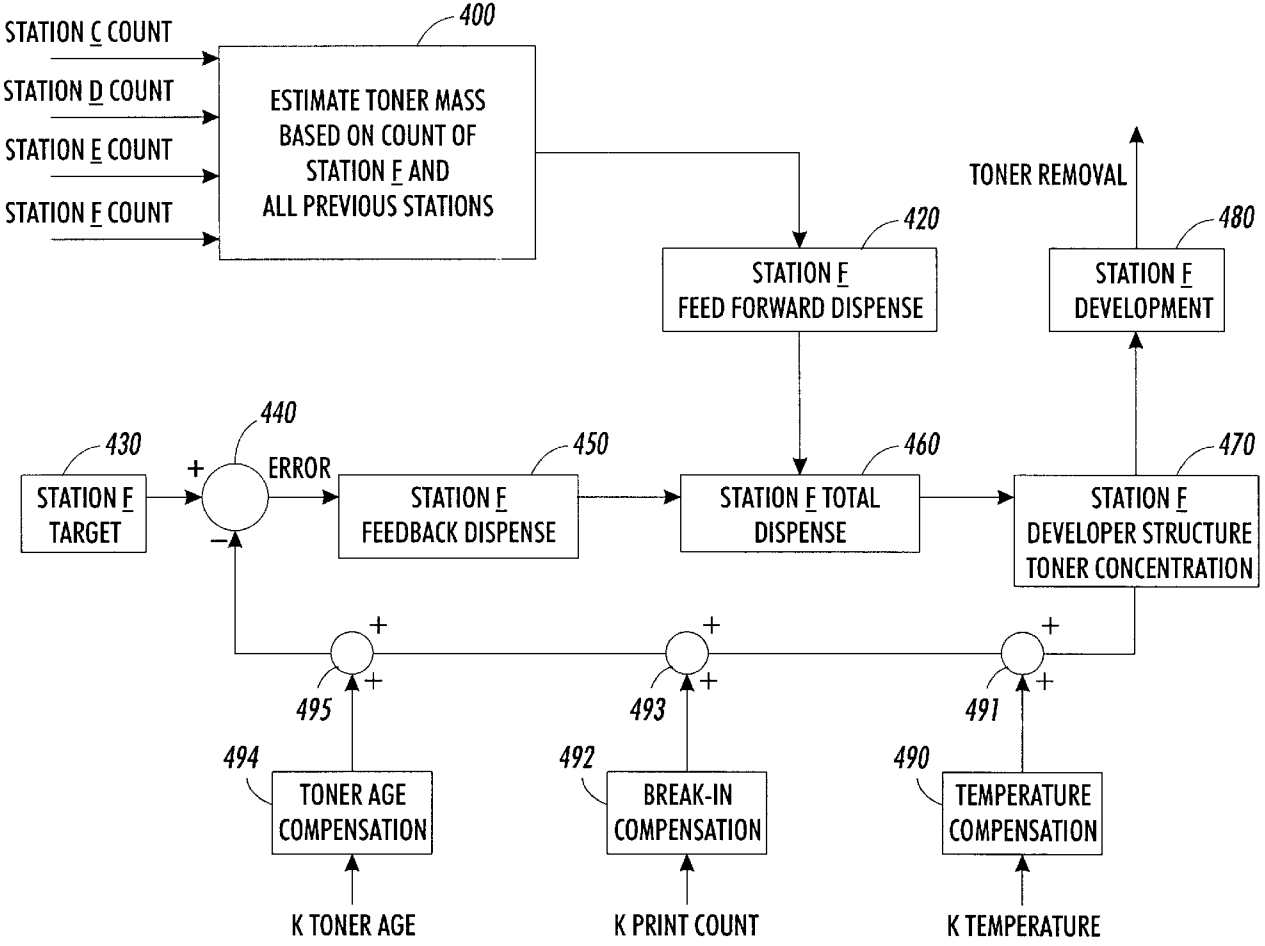
FIG. 6 is a block diagram showing both a feed forward and feedback toner concentration control for the fourth developer station in accordance with the present invention.

Turning to FIG. 6, the black toner mass of developer station F to be applied to the photoreceptor is estimated based on pixel count of station F and all previous stations (400). The black toner mass estimate is outputted to the station F feed forward dispense 420. The developer station F feed forward dispense 420 provides a feed forward dispense command to the station F total dispense 460. The station F feed forward dispense 420 provides a feed forward dispense command to request that a certain black toner mass per unit time be dispensed to the developer structure of station F to replace the black toner removed from the station F developer structure in order to maintain the proper black toner concentration (station F feed forward dispense 420).

The actual developer station F target of black toner concentration within the developer structure is generally referred to by the reference numeral 430. However, due to the impact of the temperature, break-in and toner age of the black toner particles in the developer structure, and due to the type of sensor (e.g. Packer sensor) used to obtain readings to measure toner concentration, the sensor can not directly measure the actual black toner concentration. The sensor readings indicative of the current black toner concentration of the developer structure of station F are compensated or corrected for variations in temperature (490, 491), break-in (492, 493) and toner age (494, 495). Then, the compensated or corrected black toner concentration is combined with the station F target toner concentration (440) to provide an error signal that is input to the feedback dispense 450. The feedback dispense 450 processes the error signal and outputs a feedback command to station F total dispense 460. The station F feedback command provides a dispense command to request that a certain black toner mass per unit time be dispensed to compensate or correct for variations in temperature, break-in and toner age in order to maintain the proper black toner concentration (station F feed back dispense 450).

The total black toner mass dispensed by the station F toner dispenser is determined by combining the station F feed forward dispense command with the station F feedback dispense command. The station F total dispense 460 combines the station F feed forward dispense command with the station F feedback dispense command, and outputs a station F total dispense command so that a certain black toner mass per unit time is dispensed from the station F dispenser to the station F developer structure. By dispensing the proper black toner mass, the station F developer structure toner concentration (470) can be maintained while the black toner is being removed from the station F developer structure and adhering to the latent image on the photoreceptor (station F development 480).

Figure 7:
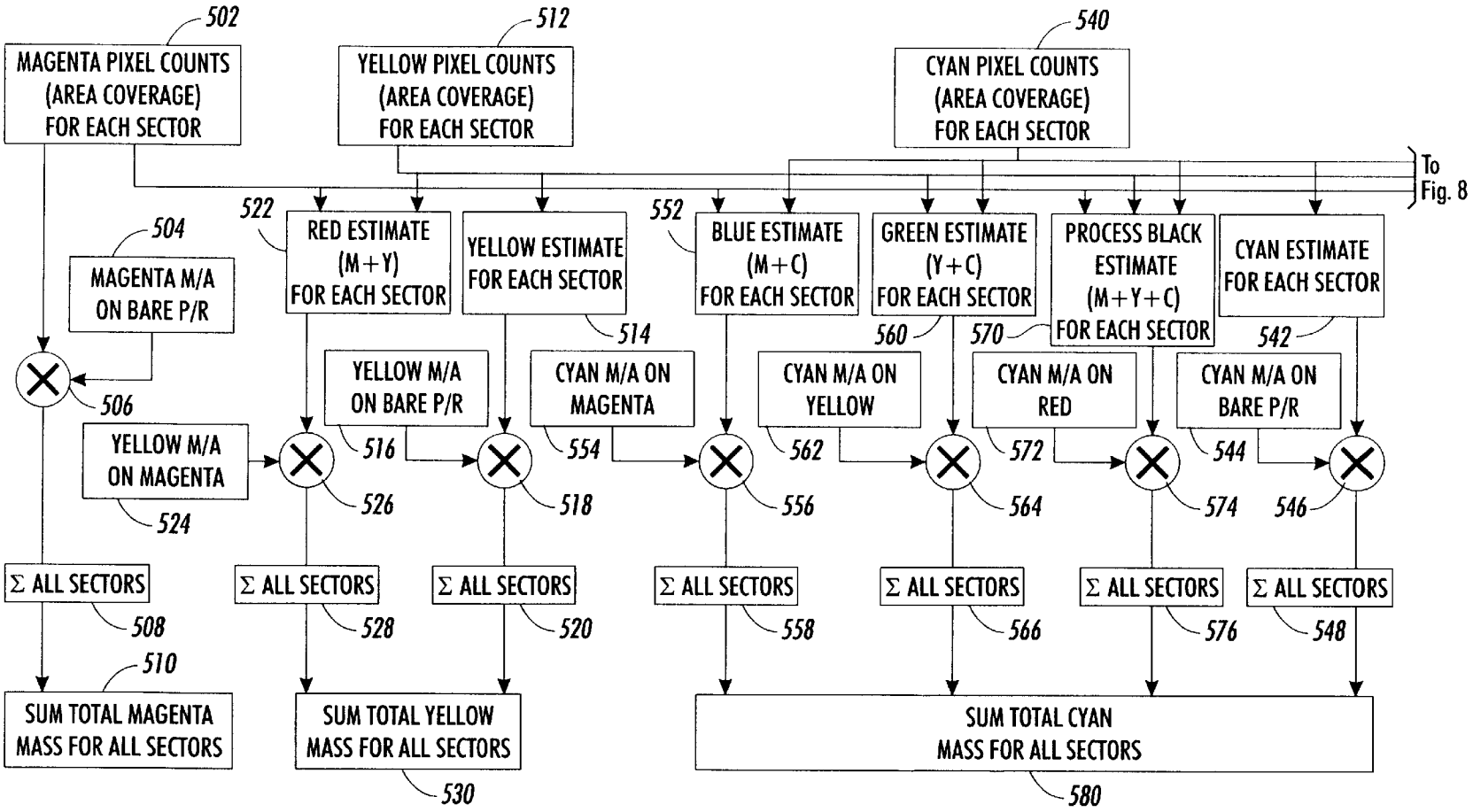
FIG. 7 is a flow chart showing the toner mass estimate for the first, second and third developer stations in accordance with the present invention.
Figure 8:
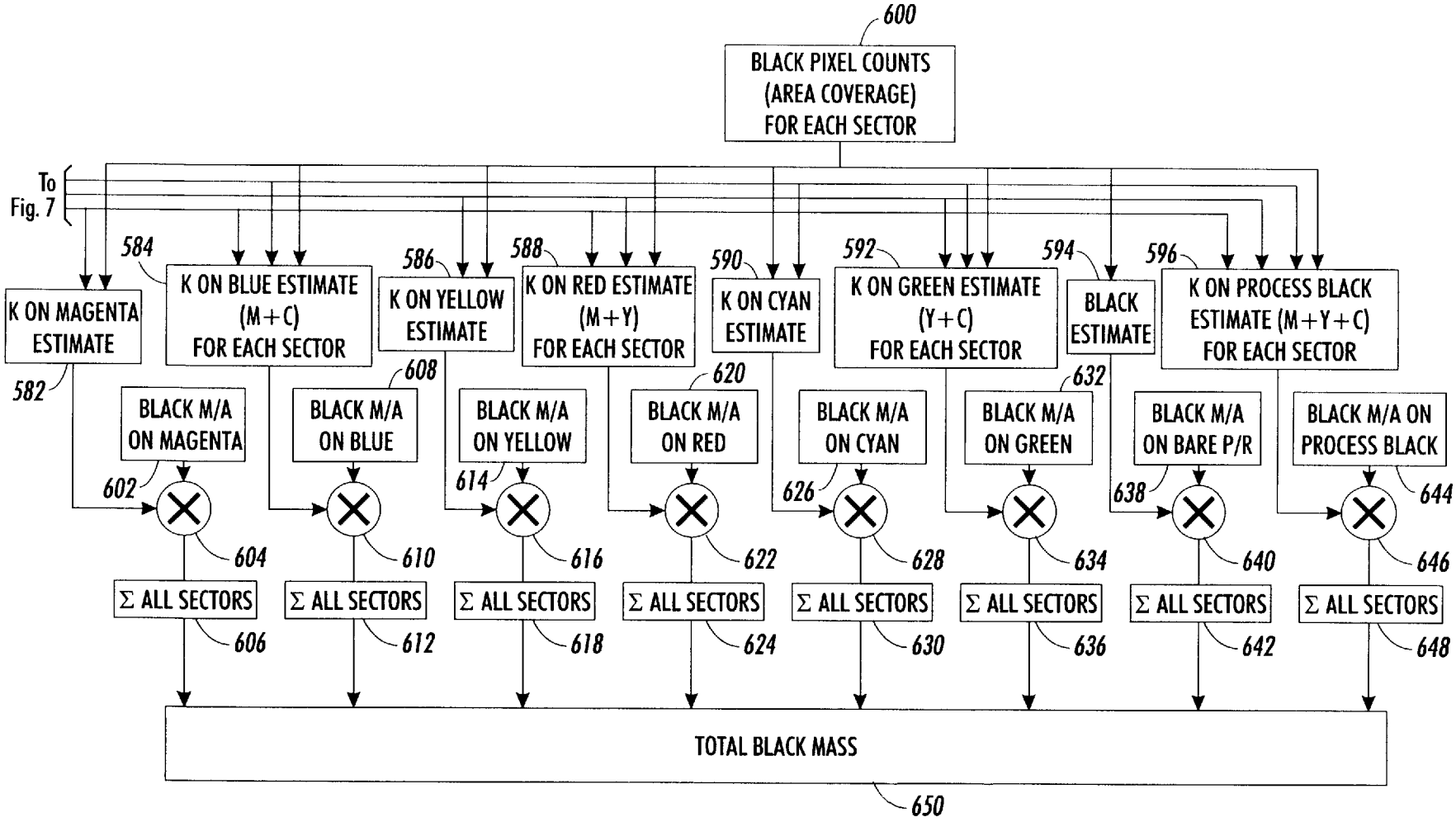
FIG. 8 is a flow chart showing the toner mass estimate for the fourth developer station in accordance with the present invention.

FIGS. 7–8 show the feed forward flow diagrams for estimating the toner mass for development of a latent image on a photoreceptor based on the number of pixel counts, which is indicative of the area coverage of each sector of the latent image on the photoreceptor.

After receiving the pixel count for magenta, yellow, cyan and black from the controller 50 by way of an image processing controller (preferably in the print engine 30), the mass of magenta toner, yellow toner, cyan toner and black toner can be ascertained for developing the sectors of the latent image. The total mass of each toner moving from each developer structure to the photoreceptor for the sector is used to determine the total feed forward dispense for each station, which is then combined with the feedback dispense for each station to provide the total station dispense.

This information is necessary in order to maintain the toner concentration in each developer structure. The toner concentration (% TC) is equal to the weight of the toner divided by the weight of the carrier.

Magenta, yellow, cyan, and black pixel counts for each sector are denoted by m, y, c, and k, respectively, and identified generally by reference numerals 502, 512, 540 and 600 respectively. The area coverage per count for magenta, yellow, cyan and black are denoted by $\sigma_m$, $\sigma_y$, $\sigma_c$, and $\sigma_k$, respectively.

Since the photoreceptor (p/r) is completely bare when it reaches the magenta developer station, the mass of magenta required to develop a sector of the latent image is determined by the following equation, $$\mathrm{M}_m = \mathrm{M}_m m \sigma_m \qquad \text{Equation (1)}$$

where $\mathrm{M}_m$ is the magenta mass in one sector; $\mathrm{M}_m$ is the magenta mass per unit area (M/A) on the bare photoreceptor (504); m is the magenta pixel count for the sector; $\sigma_m$ is the area coverage per count for magenta; and $m\sigma_m$ is the area coverage for the sector (502). The combination of the magenta mass per unit area (504) on the bare photoreceptor with the magenta area coverage for the sector (502) is denoted by reference numeral 506. By summing the magenta mass for each sector (508), the sum total of magenta mass for all sectors (510) is determined.

In order to estimate the yellow mass, which is required to develop the latent image, both the yellow toner applied to the bare photoreceptor (yellow estimate 514) and the yellow toner applied to the magenta toner covered areas of photoreceptor (red estimate 522) must be taken into account. The mass of yellow toner required to develop a sector of the latent image is determined by the following equation, $$\mathrm{M}_y = \mathrm{M}_y[y\sigma_y(1-m)] + \mathrm{M}_y\delta_{ym}[y\sigma_y m] \qquad \text{Equation (2)}$$

where $\mathrm{M}_y$ is the yellow mass in one sector; $\mathrm{M}_y$ is the yellow mass per unit area (M/A) on the bare photoreceptor (516); m is the magenta pixel count for the sector; y is the yellow pixel count for the sector; $\sigma_y$ is the area coverage per pixel count for yellow for the sector; yay is the area coverage of yellow for the sector (512); and $\delta_{ym}$ is the mass of yellow on magenta divided by the mass of yellow on the bare photoreceptor. Both $\sigma_y$ and $\delta_{ym}$ are constants. The constant $\sigma_y$ is determined by the number of sectors printed between dispense updates, thereby accounting for all printable areas of the photoreceptor. The constant $\delta_{ym}$ is the fractional mass loss due to exposure light scattering through developed toner. It depends on factors including toner size, pigment, loading and shape.

The combination of the yellow mass per unit area (M/A) on the bare photoreceptor (516) with the yellow toner estimate (514) (based on yellow area coverage 512) is the yellow mass in the sector (518). The combination of the yellow mass per unit area on magenta (524) with the red estimate 522 (based on magenta and yellow area coverages) is the yellow mass on magenta (526). By summing the yellow mass for each sector (520 and 528), the sum total of yellow mass for all sectors (530) is determined.

In order to estimate the cyan mass, which is required to develop the latent image, the cyan toner applied to the bare photoreceptor (cyan estimate 544); the cyan toner applied to the magenta toner covered areas of photoreceptor (blue estimate 552); the cyan toner applied to the yellow toner covered areas of the photoreceptor (green estimate 560); and the cyan toner applied to the areas covered by both yellow toner and cyan toner (process black estimate 570) must be taken into account. The mass of cyan toner required to develop a sector of the latent image is determined by the following equation, $$\begin{aligned}\mathrm{M}_c = {} & \mathrm{M}_c[c\sigma_c - c\sigma_c(m+y-m*y)] \\ & \mathrm{M}_c\delta_{cy}[c\sigma_c y*(1-m)] + \\ & \mathrm{M}_c\delta_{cm}[c\sigma_c m*(1-y)] + \\ & \mathrm{M}_c\delta_{cmy}[c\sigma_c my]\end{aligned} \qquad \text{Equation (3)}$$

where $\mathrm{M}_c$ is the cyan mass in one sector; $\mathrm{M}_c$ is the cyan mass per unit area (M/A) on the bare photoreceptor (544); m is the magenta pixel count for the sector; y is the yellow pixel count for the sector; c is the cyan pixel count for the sector; $\sigma_c$ is the area coverage per count for cyan; $c\sigma_c$ is the area coverage of cyan for the sector (540); $\delta_{cy}$ is the mass of cyan on yellow divided by the mass of cyan on the bare photoreceptor; $\delta_{cm}$ is the mass of cyan on magenta divided by the mass of cyan on the bare photoreceptor; and $\delta_{cmy}$ is the mass of cyan on magenta and yellow divided by the mass of cyan on the bare photoreceptor.

$\sigma_c$, $\delta_{cy}$, $\delta_{cm}$, and $\delta_{cmy}$ are constants. The constant $\sigma_c$ is determined by the number of sectors printed between dispense updates, thereby accounting for all printable areas of the photoreceptor. The constant $\delta_{cy}$ is the fractional mass loss of cyan developing on yellow. The constant $\delta_{cm}$ is the fractional mass loss of cyan developing on magenta. The constant $\delta_{cmy}$ is the fractional mass loss of cyan developing on red (magenta and yellow).

The combination of the cyan mass per unit area (M/A) on the bare photoreceptor (544) with the cyan toner estimate (542) (based on cyan area coverage 540) is denoted by reference numeral 546. The combination of the cyan mass per unit area (M/A) on magenta (554) with the blue estimate 552 (based on magenta and cyan area coverages) is denoted by reference numeral 556. The combination of the cyan mass per unit area (M/A) on yellow (562) with the green estimate 560 is denoted by reference numeral 564. The combination of the cyan mass per unit area on red 572 and process black estimate 570 is denoted by reference numeral 574. By summing the cyan mass for each sector (548, 558, 566 and 576), the sum total of cyan mass for all sectors (580) is determined.

In order to estimate the black mass, which required to develop the latent image, the following must be taken into account: (1) the black toner applied to the bare photoreceptor (black estimate 594); (2) the black toner applied to the magenta toner covered areas on the photoreceptor (black on magenta estimate 582); (3) the black toner applied to the areas covered by both magenta toner and cyan toner (black on blue estimate 584); (4) the black toner applied to the yellow toner covered areas on the photoreceptor (black on yellow estimate 586); (5) the black toner applied to the areas covered by both magenta toner and yellow toner (black on red estimate 588); (6) the black toner applied to the cyan toner covered areas on the photoreceptor (black on cyan estimate 590); (7) the black toner applied to the areas covered by both yellow toner and cyan toner (black on green estimate 592); and (8) the black toner applied to the areas covered by magenta toner, yellow toner and cyan toner (black on process black estimate 596). The mass of black toner required to develop a sector of the latent image is determined by the following equation, $$
\begin{aligned}
\mathrm{M}_k = {} & \mathrm{M}_k[k\sigma_k(1-m-y-c+my+mc+yc-myc)]+ \\
& \mathrm{M}_k\delta_{ky}[k\sigma_k(y-my-cy+myc)]+ \\
& \mathrm{M}_k\delta_{km}[k\sigma_k(m-my-mc+myc)]+ \\
& \mathrm{M}_k\delta_{kc}[k\sigma_k(c-mc-yc+myc)]+ \\
& \mathrm{M}_k\delta_{kmy}[k\sigma_k(my-myc)]+ \\
& \mathrm{M}_k\delta_{kmc}[k\sigma_k(mc-myc)]+ \\
& \mathrm{M}_k\delta_{kyc}[k\sigma_k(yc-myc)]+ \\
& \mathrm{M}_k\delta_{kmyc}[k\sigma_k(myc)] \qquad \text{Equation (4)}
\end{aligned}
$$

where $\mathrm{M}_k$ is the black mass in one sector; $\mathrm{M}_k$ is the black mass per unit area (M/A) on the bare photoreceptor (594); m is the magenta pixel count for the one sector (502); y is the yellow pixel count for the sector (512); c is the cyan pixel count for one sector (540); k is the black pixel count for the sector; $\sigma_k$ is the area coverage per count for black; $k\sigma_k$ is the area coverage of black for the sector (600); $\delta_{km}$ is the mass of black on magenta divided by the mass of black on the bare photoreceptor; $\delta_{ky}$ is the mass of black on yellow divided by the mass of black on the bare photoreceptor; $\delta_{kc}$ is the mass of black on cyan divided by the mass of black on the bare photoreceptor; $\delta_{kmy}$ is the mass of black on magenta and yellow (red) divided by the mass of cyan on the bare photoreceptor; $\delta_{kmc}$ is the mass of black on magenta and cyan (blue) divided by the mass of cyan on the bare photoreceptor; $\delta_{kyc}$ is the mass of black on yellow and cyan (green) divided by the mass of black on the bare photoreceptor; and $\delta_{kmyc}$ is the mass of black on magenta, yellow and cyan (process black) divided by the mass of black on the bare photoreceptor.

$\sigma_k$, $\delta_{ky}$, $\delta_{km}$, $\delta_{kc}$, $\delta_{kmy}$, $\delta_{kmc}$, $\delta_{kyc}$, and $\delta_{kmyc}$ are constants. The constant ok is determined by the number of sectors printed between dispense updates, thereby accounting for all printable areas of the photoreceptor. The constant $\delta_{km}$ is the fractional mass loss of black developing on magenta. The constant $\delta_{ky}$ is the fractional mass loss of black developing on yellow. The constant $\delta_{kc}$ is the fractional mass loss of black developing on cyan. The constant $\delta_{kmy}$ is the fractional mass loss of black developing on red (magenta and yellow). The constant $\delta_{kmc}$ is the fractional mass loss of black developing on blue (magenta and cyan). The constant $\delta_{kyc}$ is the fractional mass loss of black developing on green (yellow and cyan). The constant $\delta_{kmyc}$ is the fractional mass loss of black developing on process black (magenta, yellow and cyan).

The combination of the black mass per unit area (M/P) on the bare photoreceptor (638) with the black toner estimate (594) (based on black area coverage 600) is denoted by reference numeral 640. The combination of the black mass on magenta (602) with the black on magenta estimate 582 (based on black and magenta area coverage) is denoted by reference numeral 604. The combination of the black mass on blue 608 with the black on blue estimate (based on black, magenta and cyan area coverage) is denoted by 610. The combination of black mass on yellow (614) with the black on yellow estimate 586 (based on the black and yellow area coverage) is denoted by 616. The combination of the black mass on red 620 with the black on red estimate 588 (based on the black, magenta and yellow area coverage 586) is denoted by 622. The combination of the black mass on cyan 626 with the black on cyan estimate 590 (based on black and cyan area coverage) is denoted by 628. The combination of the black mass on green 632 with the black on green estimate 592 (based on black, cyan, yellow and magenta area coverage) is denoted by 634. The combination of the black mass on process black 644 and the black on process black estimate 596 (based on the black, yellow and cyan pixel counts) is denoted by 646. By summing the black mass for each sector (606, 612, 618, 624, 630, 636, 642, and 648), the sum total of cyan mass for all sectors (650) is determined.

Since the mass of all of the toners required to develop the latent image have been determined, each station can provide the necessary feed forward dispense commands.

Figure 9:
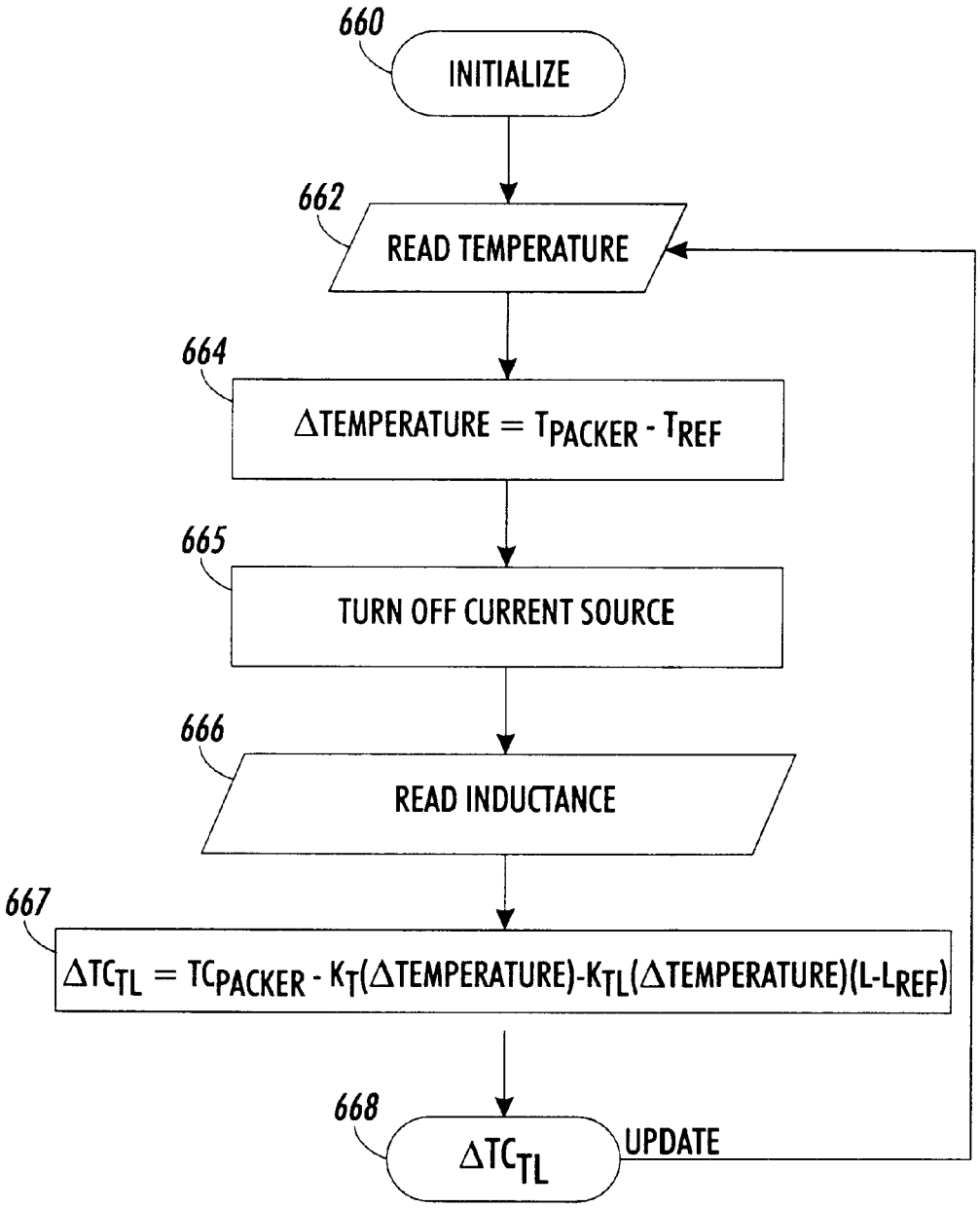
FIG. 9 is a flow chart showing temperature feedback toner concentration control for each developer station in accordance with the present invention.

With reference to FIGS. 9–11, the feedback loop, which provides the feedback dispense requirements is discussed in detail below. As indicated above, a feedback component is needed to take into account the three factors (temperature, break-in and toner age) impacting the sensor reading of the toner concentration in each developer structure. Preferably, the sensor used to sense toner concentration in each developer housing is a Packer sensor. The Packer sensor generally uses an active magnetic field to consistently arrange developer against a sense head. This field is generated by applying a known current to a solenoid ferrite core. After a certain time, the current source is turned off, and the time for the current to decay to a fixed reference value is recorded. The material in contact with the sensor face influences the effective inductance of the Packer circuit, which, in turn influences the decay time recorded by the sensor. As the toner concentration increases, the inductance decreases, and as the toner concentration decreases, the inductance increases.

A model calculation maps this decay time to a toner concentration value which is then used for feedback. The other Packer sensor output is the initial voltage across the solenoid. This voltage is used in conjunction with the given current to compute the resistance of the solenoid. Knowledge of the resistance is useful for two reasons: (1) it can be calibrated with respect to temperature so that the Packer sensor can also be used as a temperature sensor, and (2) the variability of this resistance as a function of temperature directly affects the decay time. Hence, if temperature changes are not taken into account, they will induce an error in a Packer-based toner concentration (TC) reading. Moreover, the magnitude of this temperature-induced error depends on the type of material in contact with the sensor face (e.g. developer vs. air). Therefore, temperature correction for the Packer sensor depends on both the resistive properties of the Packer circuit and the material in contact with the sensor face (i.e., the effective inductance of the circuit).

The model for TC correction due to temperature changes is as follows:

$$\Delta TC_{TL}=TC_{packer}-K_T(T-T_{REF})-K_{TL}(T-T_{REF})(L-L_{REF}) \quad \text{Equation (5)}$$

where $TC_{packer}$ is the Packer sensor reading in % TC. T is the Packer temperature (e.g. in degrees Celsius), $T_{REF}$ is the reference temperature (e.g. in degrees Celsius), $K_T$ is the temperature correction gain in unit of % TC/degrees Celsius, L is the Packer inductance(preferably in mH), $L_{REF}$ is the reference inductance (preferably in mH), and $K_{TL}$ is the temperature-inductance interaction correction gain in unit % TC/(degrees Celsius*mH).

The toner concentration reading varies as temperature and inductance change. By assuming a nominal inductance (in the range of 1 mH–3 mH) as $L_{REF}$ and a nominal temperature as $T_{REF}$ (in the range of 25° C.–35° C.), the values of $K_T$ and $K_{TL}$ are determined. The inductance reference varies with the type of toner in the developer structure, and the nominal temperature is fixed, preferably in the above range. Therefore, the values of $K_T$ and $K_{TL}$ change based on the selected nominal temperature and the selected nominal inductance.

The Packer TC measurement is based on decay time, which for a simple circuit with resistance and inductance components is proportional to the ratio of the resistance value (temperature dependent) and the inductance value (material dependent). Therefore, given the inductance of the toner and the nominal temperature, $K_T$ and $K_{TL}$ are determined based on the voltage decay time across the resistance and inductance circuit provided by the Packer sensor in the developer. $K_T$ and $K_{TL}$ are preferably stored in nonvolatile memory.

As shown in FIG. 9, the Packer sensor is initialized (660). The temperature inside a developer structure is read (662). The difference between the nominal temperature and current temperature is determined (664). The current source is turned off (665) and the inductance is read (666), so that the difference between the nominal inductance and the current inductance can be ascertained. The $\Delta TC_{TL}$ correction for correcting the reading of the toner concentration by the Packer sensor is determined using the above equation (667), and this $\Delta TC_{TL}$ correction 668 is used in the feedback component of FIGS. 3–6 (190, 290, 390, 490).

As indicated above, the control of each developer structure's toner concentration depends on the accurate measurement of the developer material's magnetic inductance. As the toner concentration is changed, the ratio of magnetic to non-magnetic material near the Packer sensor is altered, allowing the sensor to measure the change in inductance. Experience with fresh toner developer material has shown a large change in the toner concentration reading from the Packer sensor, with no change in the actual toner concentration. The change is due to developer material break-in, in which the mechanical work on the carrier beads breaks off asperities on the beads, thereby changing the properties of the material. Therefore, the toner concentration estimate must be adjusted to compensate for the break-in for each type of developer to maintain the proper toner concentration in each developer structure using the following formula $$\Delta TC_B=A[1-B\exp(-\text{print count}/C] \quad \text{Equation (6)}$$

The values for A, B and C are different for each type of developer and these values are preferably stored in a nonvolatile memory for each developer. These values can be determined by comparing the print count to the toner concentration error, where C is the constant value, A is the steady state value and A*B is the difference between the steady state value and the initial value.

As shown in FIG. 10, the Packer sensor is initialized (670). The print count is read (672) and correction for the toner concentration for break-in is calculated using the above equation (674). This $\Delta TC_B$ correction 676 is used in the feedback loop of FIGS. 3–6 (192, 292, 392, 492). The print count is then incremented (678), and the process is repeated.

As indicated above, the Packer sensor uses the magnetic permeability of developer to provide a measure of toner concentration (TC). The Packer sensor uses an active magnetic field to consistently arrange developer material against the sense head, where the field is generated by applying a known current to a solenoid with a ferrite core. After a certain time, the current source is switched to zero, and the time for the current to decay to a fixed reference value is recorded. As it turns out, the decay time depends on the magnetic permeability of the developer which, in turn, depends on the TC. The mechanism that underlies this dependence is driven by the fact that two component developer consists of toner, which is essentially plastic (non-permeable), and carrier, which is basically ferrite (permeable). Higher concentrations of toner result in a developer that is less permeable which gives a longer decay time. Characterizing this dependence allows one to compute the toner concentration as a function of decay time.

As the toner concentration is changed, the ratio of magnetic to non-magnetic material near the Packer sensor is altered, allowing the sensor to measure the change in inductance. A significant change in the Packer reading with no change in actual toner concentration occurs in prolonged runs at different area coverages. This indicates that toner age has an impact upon the decay time and therefore affects the measurement of toner concentration. The change in Packer toner concentration reading correlates well to the mean toner residence time in the developer structure. The average toner age is calculated from the current toner concentration (as read by the Packer sensor) and the loss of toner by development as measured by pixel count. A toner age estimate may be calculated using the following equations.

$$\text{New Age} = [\text{Toner Mass} - \text{Toner out}] * (\text{Old Age} + \text{period})/\text{Toner Mass} \quad \text{Equation (7)}$$

-continued $$\text{Toner Mass} = TC\ \text{reading} * \text{Carrier Mass}/100 \quad \text{Equation (8)}$$

$$\text{Toner Out} = \text{Pixel count} * DMA * \text{period} * \text{constant} \quad \text{Equation (9)}$$

DMA is the developed mass per unit area in a solid image. Period is the TC update rate and the constant takes into account the printer speed (preferably in prints per minute) and the image area. The toner age estimate recognizes that some toner has left the development structure and the remaining toner has aged incrementally during the period. Freshly added toner has an age of zero and is not counted in the above equation.

As shown in FIG. 11, the Packer sensor is initialized (680). The toner age inside a developer structure is read (682) and the correction for the toner concentration is calculated using the following equation (684).

$$\Delta TC_{TA} = A_{TA} * (\text{Toner Age}) + B_{TA} \quad \text{Equation (10)}$$

The values $A_{TA}$ and $B_{TA}$ are determined by comparing the toner concentration as a function of toner age (area coverage), where $A_{TA}$ is the intercept and is the slope $B_{TA}$, and $\Delta TC_{TA}$ correction 686 is used for the feedback loop of FIGS. 3–6 (194, 294, 394, 494).

After applying the temperature compensation, a temperature compensation estimate for each corresponding station is provided (191, 291, 391, and 491). After applying the break-in compensation along with the temperature compensation, an estimate taking into account both the temperature compensation and the break-in compensation for each corresponding station is provided (192, 292, 392, and 492).

After applying the temperature compensation, break-in compensation and toner age compensation for each corresponding station, a final estimate of each station toner concentration (195, 295, 395, 495) is provided. These final estimates are combined with the corresponding desired station toner concentration (130, 230, 330, 430) for each corresponding station, and the difference (error) between the two is used to determine the corresponding station feedback dispense command. The feed forward dispense command for each station is combined with the corresponding feedback dispense command to provide the station total dispense command for each station.

Although it is preferable to compensate for all three factors (temperature, break-in and toner age) impacting the sensor, alternative embodiments of the feedback component of the toner concentration control system may compensate for only one or a combination of two of the above factors.

Consequently, the pixel count for each color is used to provide an estimate of the mass of toner developed per unit time. From this value, a feed forward command to dispense a certain mass of toner in a particular amount of time is computed (station feed forward dispense). As a result of the errors in the mass of toner developed per unit time estimate, the dispense rate is augmented based on the error from the station target (the difference between the station target and the toner concentration estimate from the Packer sensor or the station feedback dispense) to provide a station total dispense (station total dispense command), so that the proper toner concentration is maintained.

Figure 12:
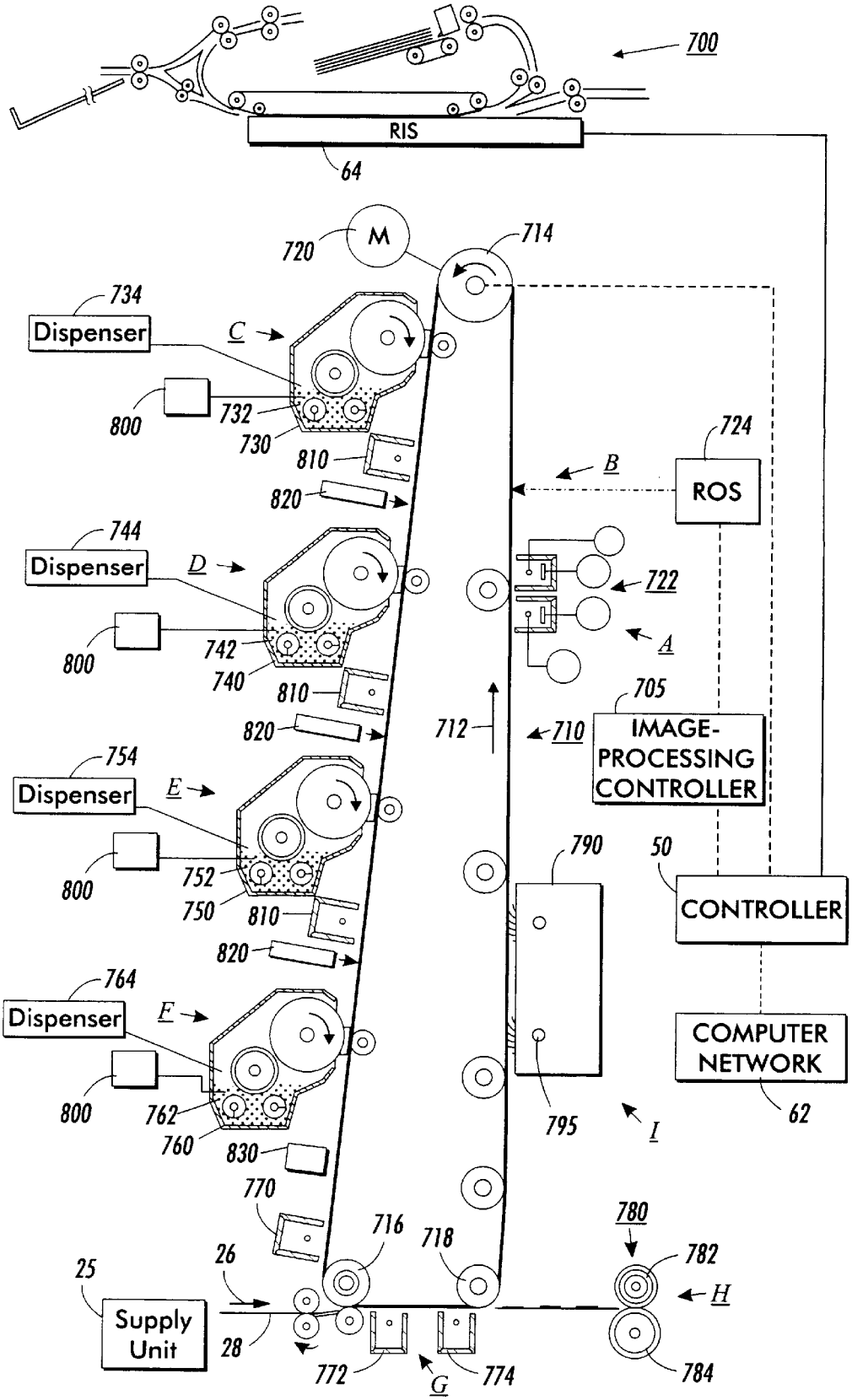
FIG. 12 is a partial schematic elevational view of an example of a digital imaging system, including a print engine, which can employ the toner concentration control system of the present invention.

FIG. 12 is a partial schematic view of a print engine of a digital imaging system, which incorporates the toner concentration control system of the present invention. The imaging system is used to produce color output in a single pass of a photoreceptor belt. It will be understood, however, that it is not intended to limit the invention to the embodiment disclosed. On the contrary, it is intended to cover all alternatives, modifications and equivalents as may be included within the spirit and scope of the invention as defined by the appended claims, including a multiple pass color process system, a single or multiple pass highlight color system and a black and white printing system.

In one embodiment, an original document can be positioned in a document handler 700 on a raster-input scanner (RIS) indicated generally by reference numeral 64. However, other types of scanners may be substituted for RIS 64. The RIS 64 captures the entire original document and converts it to a series of raster scan lines or image signals. This information is transmitted to an electronic subsystem (ESS) or controller 50. Alternatively, image signals may be supplied by a computer network 62 to controller 50. An image-processing controller 705 receives the document information from the controller 50 and converts this document information into electrical signals for the raster output scanner.

The printing machine preferably uses a charge retentive surface in the form of an Active Matrix (AMAT) photoreceptor belt 710 supported for movement in the direction indicated by arrow 712, for advancing sequentially through the various xerographic process stations. The photoreceptor belt 710 is entrained about a drive roller 714, tension rollers 716 and fixed roller 718 and the drive roller 714 is operatively connected to a drive motor 720 for effecting movement of the photoreceptor belt 710 through the xerographic stations. A portion of photoreceptor belt 710 passes through charging station A where a corona generating device, indicated generally by the reference numeral 722, charges the photoconductive surface of photoreceptor belt 710 to a relatively high, substantially uniform, preferably negative potential.

Next, the charged portion of photoconductive surface is advanced through an imaging/exposure station B. At imaging/exposure station B, the controller 50 receives the image signals representing the desired output image from raster input scanner 64 or computer network 62 and processes these signals to convert them to the various color separations of the image. The desired output image is transmitted to a laser based output scanning device, which causes the charge retentive surface to be discharged in accordance with the output from the scanning device. Preferably the laser based scanning device is a laser Raster Output Scanner (ROS) 724. Alternatively, the ROS 724 could be replaced by other xerographic exposure devices such as an LED array.

The photoreceptor belt 710, which is initially charged to a voltage $V_0$, undergoes dark decay to a level equal to about −500 volts. When exposed at the exposure station B, it is discharged to a level equal to about −50 volts. Thus after exposure, the photoreceptor belt 710 contains a monopolar voltage profile of high and low voltages, the former corresponding to charged areas and the latter corresponding to discharged or background areas.

At a first development station C, the development station C preferably utilizes a hybrid development system including a developer structure 730. The development roll, better known as the donor roll, is powered by two development fields (potentials across an air gap). The first field is the ac field which is used for toner cloud generation. The second field is the dc development field which is used to control the amount of developed toner mass on the photoreceptor belt 710. The developer structure 730 contains magenta toner particles 732. The toner cloud causes charged magenta toner particles 732 to be attracted to the electrostatic latent image. Appropriate developer biasing is accomplished via a power supply (not shown). This type of system is a noncontact type in which only toner particles (magenta, for example) are attracted to the latent image and there is no mechanical contact between the photoreceptor belt 710 and a toner delivery device to disturb a previously developed, but unfixed, image. A toner concentration sensor 800 senses the toner concentration in the developer structure 730. A dispenser 734 dispenses magenta toner into the developer structure 730 to maintain a proper toner concentration. The dispenser 734 is controlled by controller 50.

The developed but unfixed image is then transported past a second charging device 810 where the photoreceptor belt 710 and previously developed toner image areas are recharged to a predetermined level.

A second exposure/imaging is performed by device 820 which preferably comprises a laser based output structure. The device 820 is utilized for selectively discharging the photoreceptor belt 710 on toned areas and/or bare areas, pursuant to the image to be developed with the second color toner. Device 820 may be a raster output scanner or LED bar, which is controlled by controller 50. At this point, the photoreceptor belt 710 contains toned and untoned areas at relatively high voltage levels and toned and untoned areas at relatively low voltage levels. These low voltage areas represent image areas which are developed using discharged area development (DAD). To this end, a negatively charged, developer material 742 comprising the second color toner, preferably yellow, is employed. The second color toner is contained in a developer structure 740 disposed at a second developer station D and is presented to the latent images on the photoreceptor belt 710 by way of a second developer system. A power supply (not shown) serves to electrically bias the developer structure 740 to a level effective to develop the discharged image areas with negatively charged yellow toner particles 742. Further, a toner concentration sensor 800 senses the toner concentration in the developer structure 740. A dispenser 744 dispenses magenta toner into the developer structure 740 to maintain a proper toner concentration. The dispenser 744 is controlled by controller 50.

The above procedure is repeated for a third image for a third suitable color toner such as cyan 752 contained in developer structure 750 and dispenser 754 (station E), and for a fourth image and suitable color toner such as black 762 contained in developer structure 760 and dispenser 764 (station F). Preferably, developer structures 730, 740, 750 and 760 are the same or similar in structure. Also, preferably, the dispensers 734, 744, 754 and 764 are the same or similar in structure. The exposure control scheme described below may be utilized for these subsequent imaging steps. In this manner a full color composite toner image is developed on the photoreceptor belt 710. In addition, a permeability sensor 830 measures developed mass per unit area (developability). Although only one sensor 830 is shown in FIG. 12, there may be more than one sensor 830.

To the extent to which some toner charge is totally neutralized, or the polarity reversed, thereby causing the composite image developed on the photoreceptor belt 710 to consist of both positive and negative toner, a negative pre-transfer dicorotron member 770 is provided to condition all of the toner for effective transfer to a substrate.

Subsequent to image development a sheet of support material 28 is moved into contact with the toner images at transfer station G. The sheet of support material 28 is advanced to transfer station G by the supply unit 25 in the direction of arrow 26. The sheet of support material 28 is then brought into contact with photoconductive surface of photoreceptor belt 710 in a timed sequence so that the toner powder image developed thereon contacts the advancing sheet of support material 28 at transfer station G.

Transfer station G includes a transfer dicorotron 772 which sprays positive ions onto the backside of support material 28. This attracts the negatively charged toner powder images from the photoreceptor belt 710 to sheet 28. A detack dicorotron 774 is provided for facilitating stripping of the sheets from the photoreceptor belt 710.

After transfer, the sheet of support material 28 continues to move onto a conveyor (not shown) which advances the sheet to fusing station H. Fusing station H includes a fuser assembly, indicated generally by the reference numeral 780, which permanently affixes the transferred powder image to sheet 28. Preferably, fuser assembly 780 comprises a heated fuser roller 782 and a backup or pressure roller 784. Sheet 28 passes between fuser roller 782 and backup roller 784 with the toner powder image contacting fuser roller 782. In this manner, the toner powder images are permanently affixed to sheet 28. After fusing, a chute, not shown, guides the advancing sheets 28 to a catch tray, stacker, finisher or other output device (not shown), for subsequent removal from the printing machine by the operator.

After the sheet of support material 28 is separated from photoconductive surface of photoreceptor belt 710, the residual toner particles carried by the non-image areas on the photoconductive surface are removed therefrom. These particles are removed at cleaning station I using a cleaning brush or plural brush structure contained in a housing 790. The cleaning brush 795 or brushes 795 are engaged after the composite toner image is transferred to a sheet. Once the photoreceptor belt 710 is cleaned the brushes 795 are retracted utilizing a device incorporating a clutch (not shown) so that the next imaging and development cycle can begin.

Controller 50 regulates the various printer functions. The controller 50 preferably includes one or more programmable controllers, which control printer functions hereinbefore described. The controller 50 may also provide a comparison count of the copy sheets, the number of documents being recirculated, the number of copy sheets selected by the operator, time delays, jam corrections, etc. The control of all of the exemplary systems heretofore described may be accomplished automatically or through the use of user interface 58 from the printing machine consoles selected by an operator. Conventional sheet path sensors or switches may be utilized to keep track of the position of the document and the copy sheets.

In an alternative embodiment, a fifth developer station J including a device 820, developer structure 771, a magnetic ink character recognition toner 773, a dispenser 775, and a toner concentration sensor 800 is added to the digital imaging system shown in FIG 12. Preferably, the station J has the same or similar structre to stations C–F, and functions in a manner similar to or the same as stations C–F.

Figure 13:
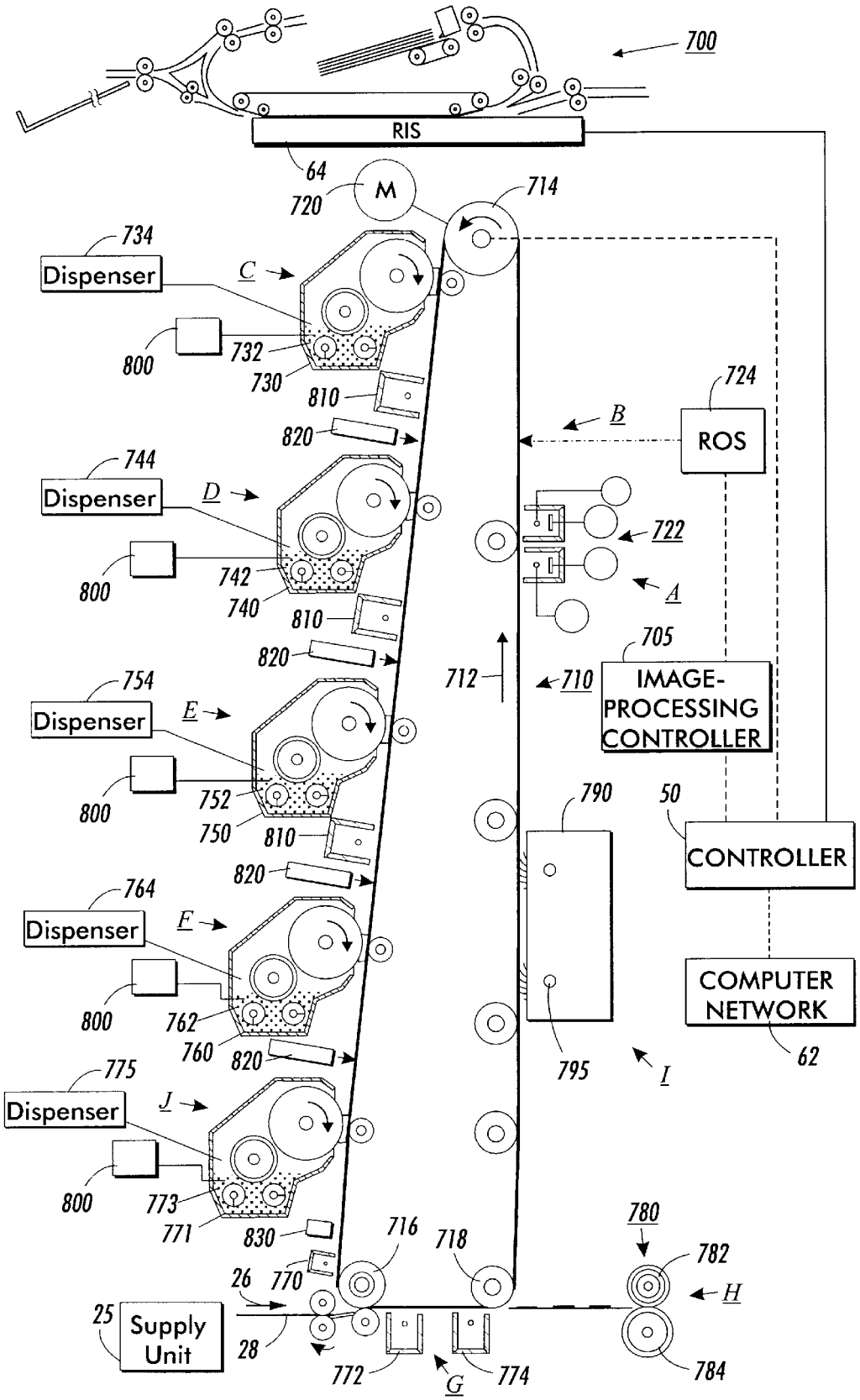
FIG. 13 is a partial schematic elevational view of another example of a digital imaging system, including a print engine, which can employ the toner concentration control system of the present invention.

While FIGS. 12–13 show examples of a digital imaging systems incorporating the feed forward toner concentration control and feedback toner concentration control of the present invention, it is understood that this method and apparatus directed toward maintaining the proper toner concentration in developer housings could be used in any imaging system having any number of developer structures.

While the invention has been described in detail with reference to specific and preferred embodiments, it will be appreciated that various modifications and variations will be apparent to the artisan. All such modifications and embodiments as may occur to one skilled in the art are intended to be within the scope of the appended claims.

What is claimed is:

1. A toner concentration control system for maintaining toner concentration in a developer structure, which is connected to a dispenser containing toner, the toner concentration control system comprising:

a toner mass estimator providing a toner mass estimate of the toner mass in the developer structure to be applied to a photoreceptor;

a feed forward dispense unit receiving the toner mass estimate and transmitting a feed forward dispense command based on the toner mass estimate;

a toner concentration target adjusted for toner break-in in the developer structure;

a feed back dispense unit receiving the adjusted toner concentration target and transmitting a feedback dispense command; and a total dispense unit receiving the feed forward dispense command and the feedback dispense command, and outputting total dispense command to the dispenser, which dispenses the toner to the developer structure in accordance with the total dispense command.

2. The toner concentration control system as in claim 1, further comprising the toner concentration target adjusted for toner age before the further adjusted toner concentration target is received by the feedback dispense unit.

3. The toner concentration control system as in claim 1, wherein the toner is selected from the group consisting of magenta, yellow, cyan and black.

4. The toner concentration control system of claim 1, wherein the toner is a magnetic ink character recognition toner.

5. A method for maintaining toner concentration in a developer structure which is connected to a dispenser and which applies toner to a photoreceptor, the method comprising:

estimating mass of the toner in the developer structure to be applied to the photoreceptor;

generating a feed forward dispense command based on the toner mass estimate;

providing a toner concentration target;

determining age of the toner in the developer structure;

adjusting the toner concentration target based on a toner break-in in the developer structure;

generating a feedback dispense command based on the adjusted toner concentration target;

generating a total dispense command by combining the feed forward dispense command with the feedback dispense command; and dispensing the toner from the dispenser into the developer structure to maintain toner concentration in the developer structure.

6. The method as in claim 5, further comprising adjusting the toner concentration target for toner age before the further adjusted toner concentration target is received by the feedback dispense unit.

7. The method as in claim 5, wherein the toner is selected from the group consisting of magenta, yellow, cyan and black.

8. The method as in claim 5, wherein the toner is a magnetic ink character recognition toner.

9. A toner concentration control system for use with developer structures containing different toners to be applied to a latent image on a photoreceptor, each developer structure connected to a corresponding dispenser and each dispenser containing a different toner, the toner concentration control system comprising:

a plurality of toner mass estimators providing an estimate of the toner mass in each developer structure to be applied to the photoreceptor;

a plurality of feed forward dispense units receiving corresponding toner mass estimates and transmitting feed forward dispense commands based on the toner mass estimates;

a plurality of toner concentration targets, each toner concentration target adjusted by toner break-in in the corresponding developer structures;

a plurality of feedback dispense units receiving the corresponding adjusted toner concentration targets and transmitting feedback dispense commands; and a plurality of total dispense units, each receiving the corresponding feed forward dispense command and the corresponding feedback dispense command, and outputting corresponding total dispense commands to the corresponding dispensers, which dispense the corresponding toners to the corresponding developer structures in accordance with the total dispense commands.

10. The toner concentration control system as in claim 9, further comprising the toner concentration targets adjusted for toner age before the further adjusted toner concentration targets are received by the feedback dispense units.

11. The toner concentration control system as in claim 9, wherein the toner concentration control system comprises four developer structures, wherein a first developer structure includes magenta toner, a second developer structure includes yellow toner, a third developer structure includes cyan toner and a fourth developer structure includes black toner.

12. The toner concentration control system as in claim 11, wherein the toner concentration control system includes a fifth developer structure containing a magnetic ink character recognition toner.

13. The toner concentration control system as in claim 9, wherein at least one of the developer structures contains magnetic ink character recognition toner.

14. A method for maintaining toner concentration in a plurality of developer structures containing different toners to be applied to a latent image on a photoreceptor, each developer structure being connected to a corresponding dispenser and each dispenser containing a different toner, the method comprising:

estimating mass of each toner to be applied to the photoreceptor;

generating a feed forward dispense command for each developer structure based on the corresponding toner mass estimate;

providing a toner concentration target for each toner in each developer structure;

determining age of the toner in each developer structure;

adjusting each toner concentration target based on toner break-in in each corresponding developer structure;

generating feedback dispense commands for each developer structure based on the corresponding adjusted toner concentration targets;

generating total dispense commands for each developer structure by combining corresponding feed forward dispense commands with corresponding feedback dispense commands; and dispensing toners from dispensers into the corresponding developer structures to maintain toner concentrations in the developer structures.

15. The method as in claim 14, further comprising adjusting the toner concentration target for toner age before the further adjusted toner concentration target is received by the feedback dispense unit.

16. The method as in claim 14, wherein a first developer structure includes magenta toner, a second developer structure includes yellow toner, a third developer structure includes cyan toner and a fourth developer structure includes black toner.

17. The method as in claim 16, wherein the toner concentration control system includes a fifth developer structure containing a magnetic ink character recognition toner.

18. The method as in claim 16, wherein the toner concentration control system includes at least one developer structure containing a magnetic ink character recognition toner.

19. A digital imaging system for generating an image from image signals comprising:

a photoreceptor;

a plurality of charging units charging the photoreceptor;

a plurality of exposure units receiving the image signals and exposing the photoreceptor to place a latent image on the photoreceptor based on the image signals;

a plurality of developer structures, each developer structure being connected to a corresponding dispenser, and each dispenser having a different toner;

a plurality of toner mass estimators providing toner mass estimates to be applied to the photoreceptor by way of the developer structures;

a plurality of feed forward dispense units receiving the toner mass estimates and transmitting feed forward dispense commands based on the toner mass estimates;

a plurality of toner concentration targets, each toner concentration target being adjusted by toner break-in in the corresponding developer structure;

a plurality of feedback dispense units receiving the adjusted toner concentration targets and transmitting feedback dispense commands;

a plurality of total dispense units, each total dispense unit receiving the corresponding feed forward dispense command and the corresponding feedback dispense command, and each total dispense unit outputting a corresponding total dispense command to each corresponding dispenser, wherein each corresponding dispenser dispenses toner to the corresponding developer structure in accordance with the corresponding total dispense command to maintain toner concentration in each corresponding developer structure so that each toner is applied to the latent image;

a transfer unit transferring the toner on the photoreceptor to a support material;

a fusing unit fusing the toner to the support material; and a cleaner cleaning the photoreceptor after the support material has passed through the transfer unit.

20. The digital imaging system as in claim 19, further comprising the toner concentration targets adjusted for toner age before the further adjusted toner concentration targets are received by the feedback dispense units.

21. The digital imaging system as in claim 19, further comprising a scanner for scanning the image, generating the image signals and transmitting the image signals to the exposure units.

22. The digital imaging system as in claim 19, wherein the digital imaging system is coupled to a computer network and receives image signals from the computer network.

23. The digital imaging system as in claim 19, wherein a first developer structure includes magenta toner, a second developer structure includes yellow toner, a third developer structure includes cyan toner and a fourth developer structure includes black toner.

24. The digital imaging system as in claim 23, wherein the digital imaging system further comprises a fifth developer structure containing a magnetic ink character recognition toner.

25. The digital imaging system as in claim 19, wherein at least one of the developer structures contains a magnetic ink recognition toner.

* * * * *